US005743969A

United States Patent [19]

Lawler

[11] Patent Number: 5,743,969

[45] Date of Patent: Apr. 28, 1998

[54] METHOD FOR TREATING THE OUTER SURFACE OF PIPE

[76] Inventor: Oliver Wayne Lawler, 307 Banana Bend Loop, Highlands, Tex. 77562

[21] Appl. No.: 641,178

[22] Filed: Apr. 30, 1996

Related U.S. Application Data

[60] Division of Ser. No. 106,928, Aug. 16, 1993, Pat. No. 5,615,696, which is a continuation-in-part of Ser. No. 919, 534, Jul. 24, 1992, abandoned.

[51] Int. Cl.[6] ..... B08B 3/02

[52] U.S. Cl. ..... 134/10; 134/34; 134/104.2; 134/172; 118/305; 118/307; 118/DIG. 1; 451/92

[58] Field of Search ..... 134/22.12, 22.18, 134/34, 10, 172, 104.2; 451/92, 87, 89; 118/305, 307, DIG. 1

[56] References Cited

U.S. PATENT DOCUMENTS

| | | | |
|---|---|---|---|
| 4,953,496 | 9/1990 | Taylor et al. | 118/72 |
| 5,056,271 | 10/1991 | Rose | 451/92 |
| 5,074,323 | 12/1991 | Chapman et al. | 134/181 |
| 5,092,357 | 3/1992 | Chapman et al. | 134/181 |
| 5,226,973 | 7/1993 | Chapman et al. | 134/34 |

FOREIGN PATENT DOCUMENTS

| | | | |
|---|---|---|---|
| 0214841 | 4/1987 | European Pat. Off. | 134/172 |

*Primary Examiner*—Robert J. Warden
*Assistant Examiner*—Saeed Chaudhry
*Attorney, Agent, or Firm*—Gunn & Associates, P.C.

[57] ABSTRACT

The disclosed method relate to a cleaning nozzle which, in multiple embodiments, is rotated in a circle or in an ellipse, being one nozzle in one embodiment and multiple nozzles in alternate embodiments so that the surface of a pipeline can be clean with high pressure water or other fluids. Furthermore, the rotating nozzle is supported in a carriage in one embodiment which encircles and travels along a pipeline. The carriage is supported by drive wheels which cooperate with separate drive motors and a control circuit to assure that the carriage remains upright. Multiple rotating nozzles are supported in the carriage to clean adjacent portions of the pipeline. Alternate embodiments are shown for cleaning a horizontal surface with a hand pushed or motorized version, and another version is disclosed supported on a moveable boom, thereby enabling cleaning of an upstanding vertical surface such as the hull of a ship.

15 Claims, 21 Drawing Sheets

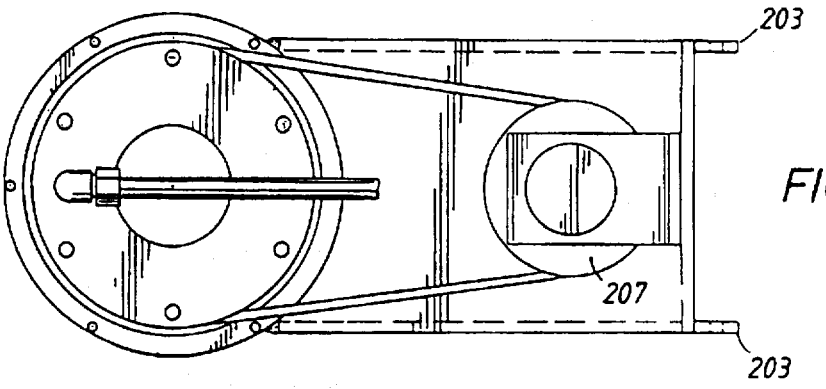
FIG. 16
FIG. 15
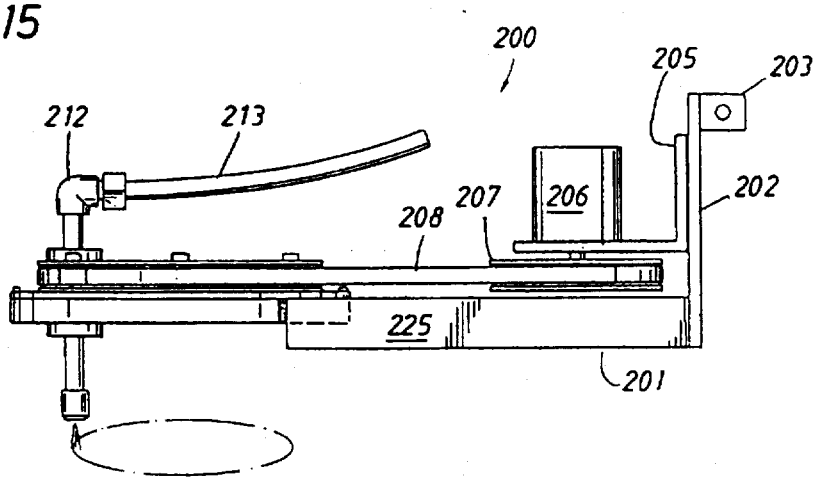
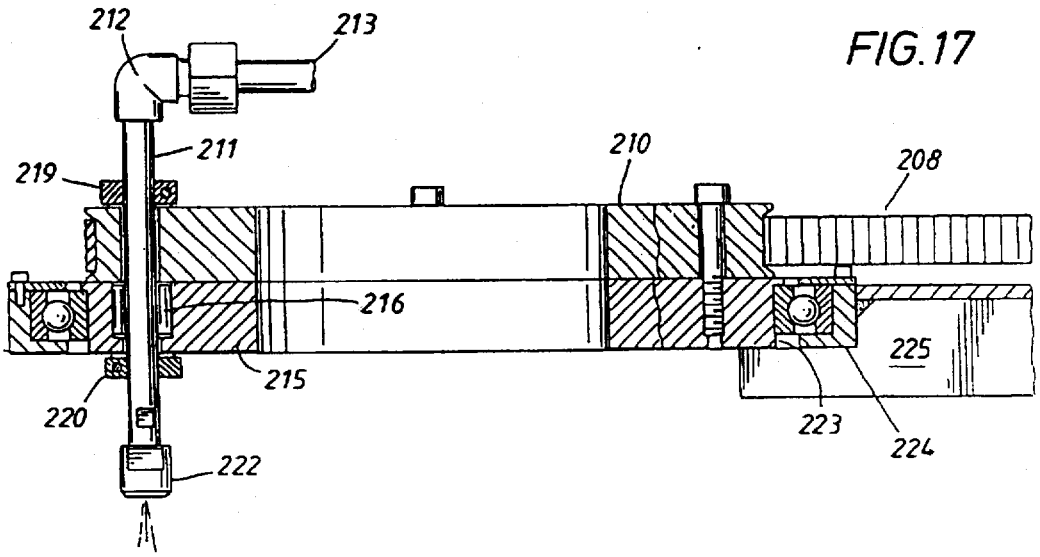
FIG. 17

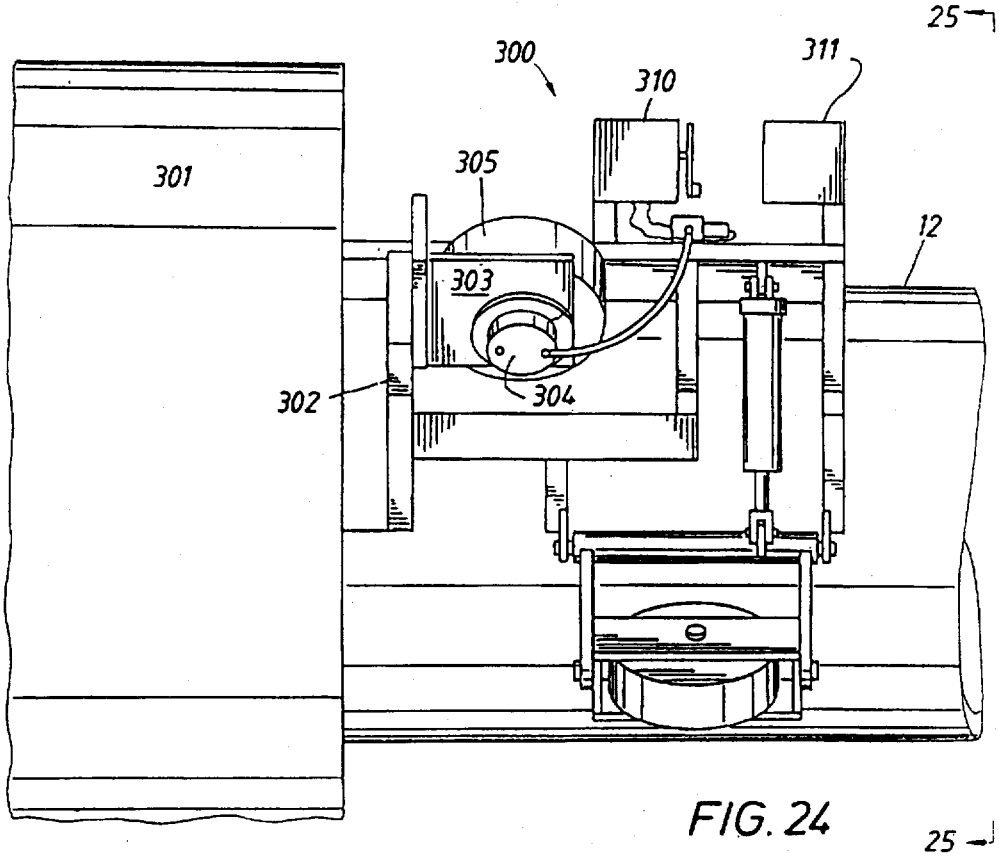
FIG. 24
FIG. 25
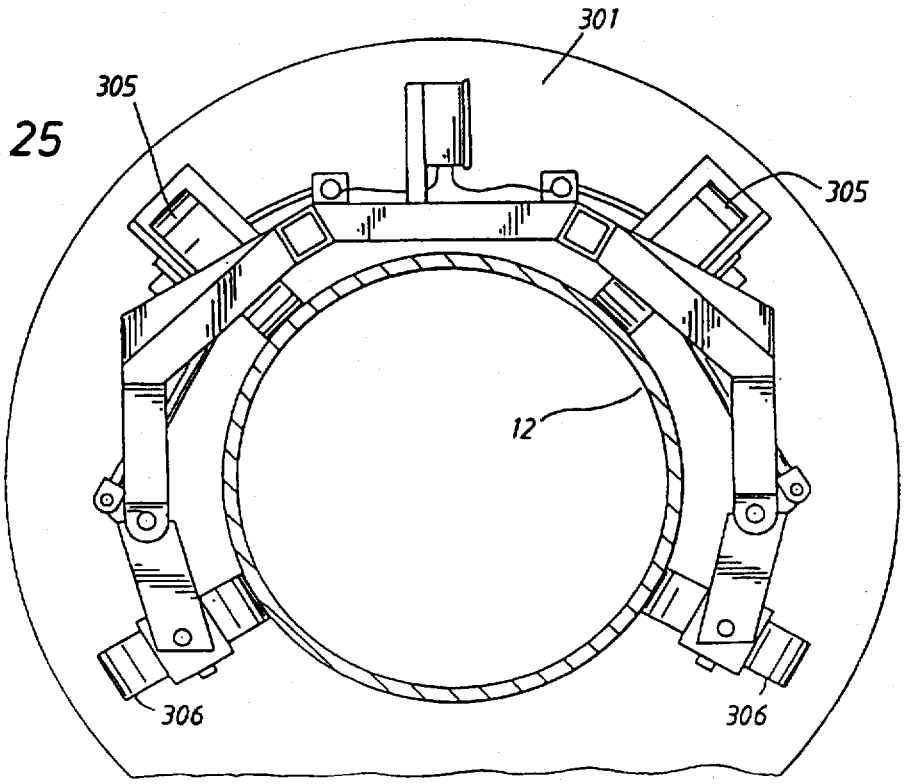

FIG. 26
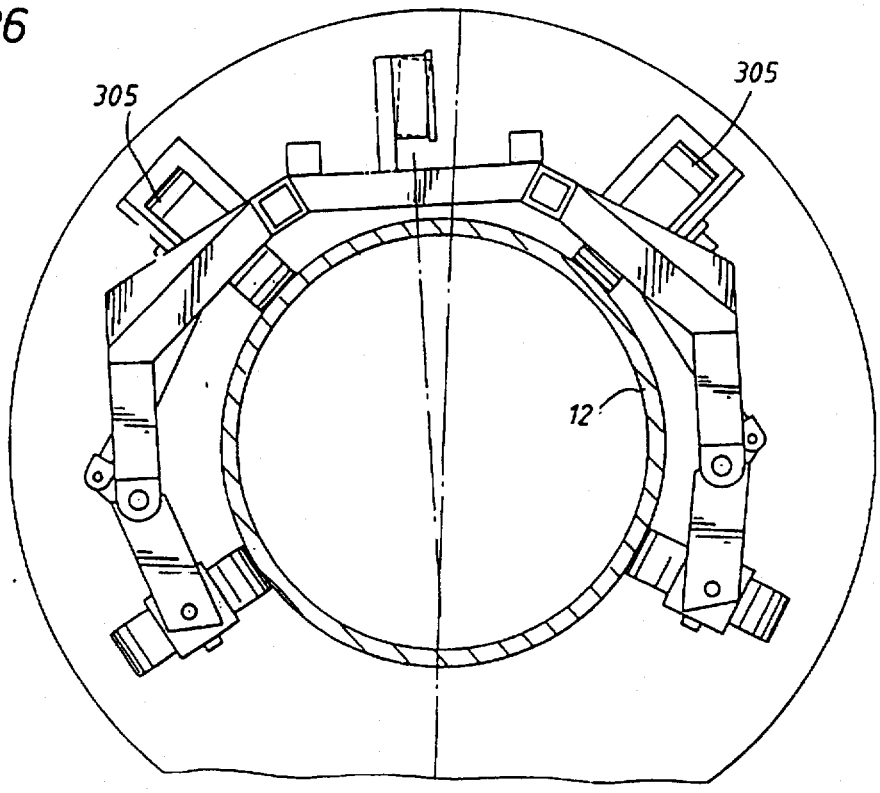
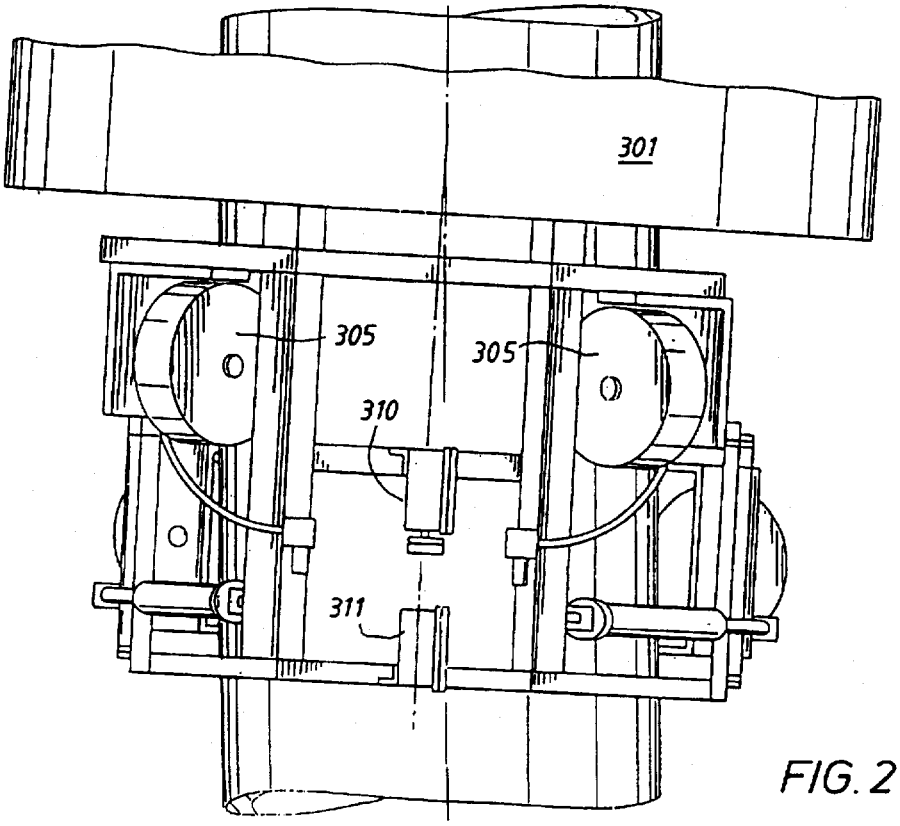
FIG. 27

METHOD FOR TREATING THE OUTER SURFACE OF PIPE

This application is a DIVISION of application Ser. No. 08/106,928, filed Aug. 16, 1993, now U.S. Pat. No. 5,615,696 which was in turn a continuation-in-part of application Ser. No. 919,534 which was filed on Jul. 24, 1992, and now abandoned.

BACKGROUND OF THE DISCLOSURE

The present disclosure relates to an apparatus and method for treating the exterior surface of a pipe or pipeline, and more particularly to such an apparatus and method including a carriage mounted on the pipeline for longitudinal movement along the pipeline and having discharge nozzles for the discharge of treating material against the outer surface of the pipeline.

The present invention is particularly used with pipelines which have been coated with various materials. When oil and gas products were first discovered, they were delivered by pipelines including hollow wood pipe. As metal pipelines were developed, it was discovered that the interaction of the pipeline with the soil in which it was buried created a problem. For instance, the soils give rise to corrosive attack on the pipeline surface. Another aspect of this derives from the cathodic interaction by which a pipeline buried in the earth operates as an active electrode in a distributed electrical system. It finds close analogy to an electrode in solution, which, when provided with a current flow, creates a current flow which deposits portions of a metal from the wall of the pipeline into the earth. It is possible for the entire thickness of the metal pipeline to be deposited in the earth thereby destroying the pipeline. When this occurs, the pipeline will no longer hold pressure and the metal which makes up the wall of the pipe will be diffused into the soil and will have no substantial strength. This problem was overcome originally by coating the pipe with felt and tar. That is an effective barrier against electrolysis of the metal which removes the metal, depositing the metal in the soil and thereby destroying the pipe. More recently, alternate forms of coating have been devised including various ceramics or plastics which are applied in a baking process. Appropriately applied coating materials are believed to be well known. Regrettably, such coating materials ultimately age and require renewal. While it is possible to put a new coating on an old coating, it is more desirable to place a new coating on clean pipe. This assures that the new coating does not flake or break away with flaking of the underlying old coating. Therefore, the old or original coating on the pipe is preferably removed. While it can be mechanically removed with a scraper blade or other kind of cutting devise, the more desirable approach is to remove the coating with a blasting process such as that set forth in the present disclosure. U.S. Pat. No. 5,052,423 discloses an apparatus for directing high pressure water in a pressurized jet of around 20,000 to 35,000 psi. A plurality of nozzles are mounted circumferentially about a pipe in a pipeline with each nozzle being rotated along a circular path while the apparatus moves along the pipeline. The circular paths of adjacent nozzles overlap so that the entire outer surface area of the pipeline is cleaned as the apparatus moves longitudinally along the pipeline. A pair of jet nozzles are mounted for rotation on an arm or jet head extending through a rotary seal for rotation. Such rotary seal is subjected to wear and frequent replacement particularly at the very high pressures and rotational speeds involved.

In the event the waste material from the cleaning operation by the apparatus in the aforementioned U.S. Pat. No. 5,052,423 contains materials which are environmentally unacceptable and are collected for disposal at a separate remote site, a sump is provided beneath the cleaning devise to catch the water and waste material from the cleaning operation. The slurry of water and waste material is then pumped by suitable vacuum pumps to disposal tanks for transport to a remote disposal site.

The pressure of the water is established to effectively remove the coating or other material on the pipeline without damaging the substrate or pipe. Thus, the speed of the longitudinal movement of the cleaning apparatus along the pipeline, together with the rotational or linear speed of the rotating water jet, must also be determined in order to provide the most effective cleaning action without damage to the pipe. Thus, rotary seals associated with the rotating nozzles or swivel heads are subjected to vibrations and wear from the high pressures and speeds involved which results in a short life thereby requiring costly replacements. One of the key features of the disclosed apparatus is provision of a nozzle capable of sweeping over a broad area using a system operating at pressure over 30,000 psi. This system covers a wide area with a nozzle moving over the area. Nozzle movement, even rotating movement is accomplished by a piped system which does not have any high pressure seals in it. The nozzle movement is accommodated by a flexible hose connection to a moving nozzle with no seals to fail.

U.S. Pat. No. 5,069,234 and U.S. Pat. No. 5,107,633 disclose an apparatus for cleaning the outer surface of a pipe in which a housing having nozzles mounted on the housing in a fixed relation and the housing including the fixed nozzles thereon are oscillated in an arcuate travel path sufficient to clean the entire surface of the pipe.

U.S. Pat. Nos. 4,552,594 and 4,677,998 are also directed to apparatus for removing coatings from pipe which includes discharge nozzles which direct water jets against the outer surface of the pipe in a zigzag path. The zigzag path is obtained by the simultaneous movement of the water jets in a longitudinal movement along the pipe while being oscillated back and forth in a direction concentric to the outer surface of the pipe.

SUMMARY OF THE INVENTION

In one form of this system, the present invention is particularly directed to a water jetting apparatus and method for cleaning the exterior surface of a pipe including directing pressurized water at a very high pressure between 20,000 and 40,000 psi against the surface of the pipe. Discharge nozzles are spaced at equal arcuate intervals, such as 60 degrees for example, about the outer periphery or circumference of the pipe for directing the high pressure water jet against the pipe. Each discharge nozzle is separately mounted for 360 degrees rotation without the utilization of any associated seal. The elimination of the requirement for rotary seals for a rotating nozzles or nozzle heads results in long life nozzle assemblies. The nozzles, moving relative to the pipe, typically cover a part of the pipe surface. The several nozzles preferably move in a controlled pattern over the pipeline surface divided into equal portions for treatment. The preferred form equipment is a system of preferably identical nozzles where each nozzle pattern is identical, moving in equal motions over equal designated areas. Obviously, the areas assigned to each nozzle can be different in size, for instance, in the situation in which the pipeline periphery is not uniformly coated with the protective coating.

The water jetting apparatus includes a self propelled carriage mounted on the pipe and adapted for longitudinal movement along the pipeline in a series of separate, short longitudinal or axial distances along the pipeline with a dwell or time interval between adjacent longitudinal movements during the cleaning operation. At the end of each longitudinal movement of the carriage, high pressure nozzles on the carriage spaced at arcs about the outer periphery of the pipe are oscillated for cleaning a cylindrical band on the outer periphery of the pipe while the carriage is supported on the pipe in a stationary position. Then, the oscillation is ended and the carriage is moved another step longitudinally along the pipe. In this manner the entire periphery of the pipe is cleaned by the nozzles in a series of generally cylindrical bands. The nozzle while oscillating, simultaneously rotates 360 degrees to permit the water jets striking the pipe to form a relatively wide cylindrical band about the pipe during oscillation of the nozzles. This disclosure sets out several nozzle movement patterns which patterns can be scaled up or down in size. Representative patters will be described.

The high pressure nozzles are mounted on an oscillating frame which oscillates or travels along a predetermined arcuate path in a range of 20 degrees to 40 degrees, for example, as necessary to assure that the entire outer peripheral surface or circumference of the pipe is cleaned. The angular range of arcuate travel depends on various factors such as the number of nozzles, the diameter of the pipe, and the path length transcribed by each nozzle. For example, if six nozzles are spaced at arcuate intervals of 60 degrees about the outer periphery of a pipe having a diameter of four feet and each nozzle traces or transcribes a spiral band having a width or diameter of around ten inches, for example, and the nozzle frame with the nozzles thereon may oscillate along a travel arc of around 50 degrees for example. The arcuate travel may be adjusted by the location of limit switches contacted by the oscillating frame at opposite ends of the travel arc as desired for various pipe diameters. The speed of the oscillating travel may also be varied to provide optimum cleaning performance and production rate based on the difficulty of removing the material from the pipe (i.e., depth of coating to be removed). Since the nozzles are mounted on an oscillating frame in a path concentric to the pipeline, the nozzles do not require overlapping travel paths and thus may trace or transcribe a relatively small width band thereby to permit a more concentrated cleaning action from the high pressure water. The oscillating frame is mounted for oscillation on a carriage supported for longitudinal movement along the pipe thereby to provide a predetermined distance between the discharge orifices of the nozzles and the outer surface of the pipeline. The nozzles may be adjusted in height or clearance on the oscillating frame to vary the distance between the discharge nozzles and outer surface of the pipe as desired.

The cleaning apparatus includes an outer enclosed housing or shell about the nozzles and pipe to collect the water and waste material or debris from the cleaning operation. Certain materials removed from the pipe, such as asbestos, are hazardous or environmentally unacceptable and are collected for disposal at a separate approved disposal site. Also, it is desirable to conserve water and to use recirculating water for the cleaning operation. The bottom of the housing forms a sump for collecting the water and waste material which is removed to collection and recirculating means positioned on separate vehicles adjacent the pipe. A filter removes the waste material from the water and the water is cooled and returned to the nozzles for reuse. Thus, a self contained water recycling system and waste collection system is provided without the utilization of any separate vacuum or pump trucks. As a result of the above, a minimal amount of water is required for the cleaning operation.

The present disclosure sets out several alternate versions of a rotating nozzle mechanism. In one instance, the nozzle is rotated in a circle. The nozzle can be raised and lowered with respect to the work service which is being cleaned, that surface normally supporting the coating that is on the pipe. Because it can be raised or lowered, the equipment is adjustable so that it might accommodate cleaning pipelines of different diameters. Moreover, the cleaning apparatus can move the nozzle in a circle, but it can also move the nozzle in an ellipse. Through the use of a transverse header supporting more than one nozzle, a set of similar nozzles can be moved in a similar elliptical pattern to thereby clean a surface of greater width.

One aspect of the present system is the provision of a cleaning system which can clean a wider surface arc which is planar. To this end, there arc embodiments set forth which clean a ground surface area. Several different embodiments are illustrated which include one or multiple rotating nozzles which provide the circular cleaning action or elliptical cleaning movement. In these embodiments, the surface typically is an exposed work surface such as in a workshop, an airport runway or other surface which is heavily coated with unwanted deposits to be stripped from the surface. Another embodiment utilizes the cleaning nozzle of the present system in a rectangular cabinet or housing to limit backsplash which is supported on an extending boom to clean the side of an upstanding surface. One such surface is the side of a ship hull. In this particular embodiment, the boom is similar to a cherry picker which enables the cleaning device to be raised and lowered adjacent to the hull for cleaning purposes.

Alignment of the cleaning apparatus with respect to the surface to be cleaned normally poses no problem when cleaning a horizontal surface. As mentioned, cleaning a vertical surface or one that is nearly vertical as in the instance of a ship hull can be carried out by using a cherry picker mechanism for extension to a desired vertical elevation.

Cleaning a pipeline requires that the apparatus be registered with respect to the pipeline as it travels the length of the pipeline. The cleaning apparatus incorporates a carriage which is self propelled along the pipeline. There is always the possibility that it will track crookedly, thereby rotating around the pipeline. The present disclosure sets forth a mechanism which restores the carriage and the associated equipment to an upstanding position. In one embodiment, this utilizes a control circuit which is connected to a pair of drive motors. The drive motors rotate spaced drive wheels which bracket the pipeline, thereby supporting the weight of the carriage on the top side of the pipeline. As long as the two drive wheels are operated in unison, they typically travel together at the same velocity, thereby moving along the length of the pipeline. If partial rotation is initiated for any reason, the control system incorporates a control circuit which responds to a departure from the upstanding or upright position, thereby driving one of the motors for a longer interval than the other which motors restore the carriage to the vertical position. By this approach, the carriage is prevented from rotating around the pipeline.

One aspect of this invention is to provide an apparatus and method for cleaning the exterior surface of a pipe or pipeline utilizing discharge nozzles for discharging pressurized water at very high pressures of between 20,000 and 40,000 psi against the pipe.

One advantage of this invention is to provide an apparatus and method for treating the outer circumference of a pipeline including a carriage mounted for movement along the pipeline in a series of separate steps and supporting discharge nozzles mounted for oscillation at the end of each step when the carriage is stopped, thereby to treat a cylindrical band extending about the entire circumference of the pipeline by the treating material discharged by the nozzles against the pipeline.

In another feature, a self-propelled carriage is supported on the pipeline for longitudinal movement along the pipeline for mounting a plurality of nozzles for oscillating movement when the carriage is in a stationary position on the pipe with high pressure water jets from the nozzles forming a cylindrical band on the outer periphery of the pipeline. The alternate pattern of nozzle motion over the surface of the pipe line are disclosed.

It is another object of this invention to provide a self-propelled carriage supported on the pipe for longitudinal movement along the pipe in a series of short longitudinal movements separated by time intervals for its discharge of high pressure water against the pipe from high pressure nozzles when the carriage is stopped.

It is a further aspect of this invention to provide such an apparatus and method in which a plurality of nozzles are spaced at predetermined equal arcuate intervals about the periphery of the pipe and are mounted for 360 degrees rotation while oscillating in a predetermined arcuate travel path concentric to the outer surface of the pipeline for cleaning the entire outer peripheral surface of the pipe in a series of contiguous cylindrical bands. The bands cumulatively encircle the pipeline. They can be equal or can be equal or can vary in arcuate range.

Another object is to provide a recirculation and collection system for use in cleaning of the outer surface of a pipe by high pressure water utilizing a minimal amount of water.

Another feature relates to the provision of a high pressure water delivery system having no seals; this sealless system provides replicated nozzles which move in a repetitive cleaning pattern accomplished by a nozzle supported on a rotational drive mechanism importing movement in a circle, ellipse, or other patters.

BRIEF DESCRIPTION OF THE DRAWINGS

So that the manner in which the above recited features, advantages and objects of the present invention are attained and can be understood in detail, more particular description of the invention, briefly summarized above may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 15 is a side view of a rotating nozzle incorporating a mechanism for providing rotary motion;

FIG. 16 is a top or plan view of the apparatus shown in FIG. 15 showing a belt drive mechanism;

FIG. 17 is an enlarged sectional view through the apparatus shown in FIGS. 15 and 16 jointly showing a belt drive pulley and a rotating nozzle support in a bearing assembly;

FIG. 24 is a side view of an alternate embodiment of the present disclosure showing a method and mechanism by the which the apparatus travels on the pipe;

FIG. 25 is a sectional view taken along the line 25—25 in FIG. 24 showing details of construction of the mechanism so that wheels engaging the pipe are more fully illustrated, and also showing how the apparatus mounts on the pipe;

FIG. 26 is a sectional view similar to FIG. 25 showing a canted position in comparison with FIG. 25 which involves angular alignment on the pipe;

FIG. 27 is a top view of the apparatus shown in FIG. 26 further showing details of the alignment of the equipment on the pipe as it tracks the pipe at a canted angle;

DETAILED DESCRIPTION OF THE INVENTION

Figure 1:
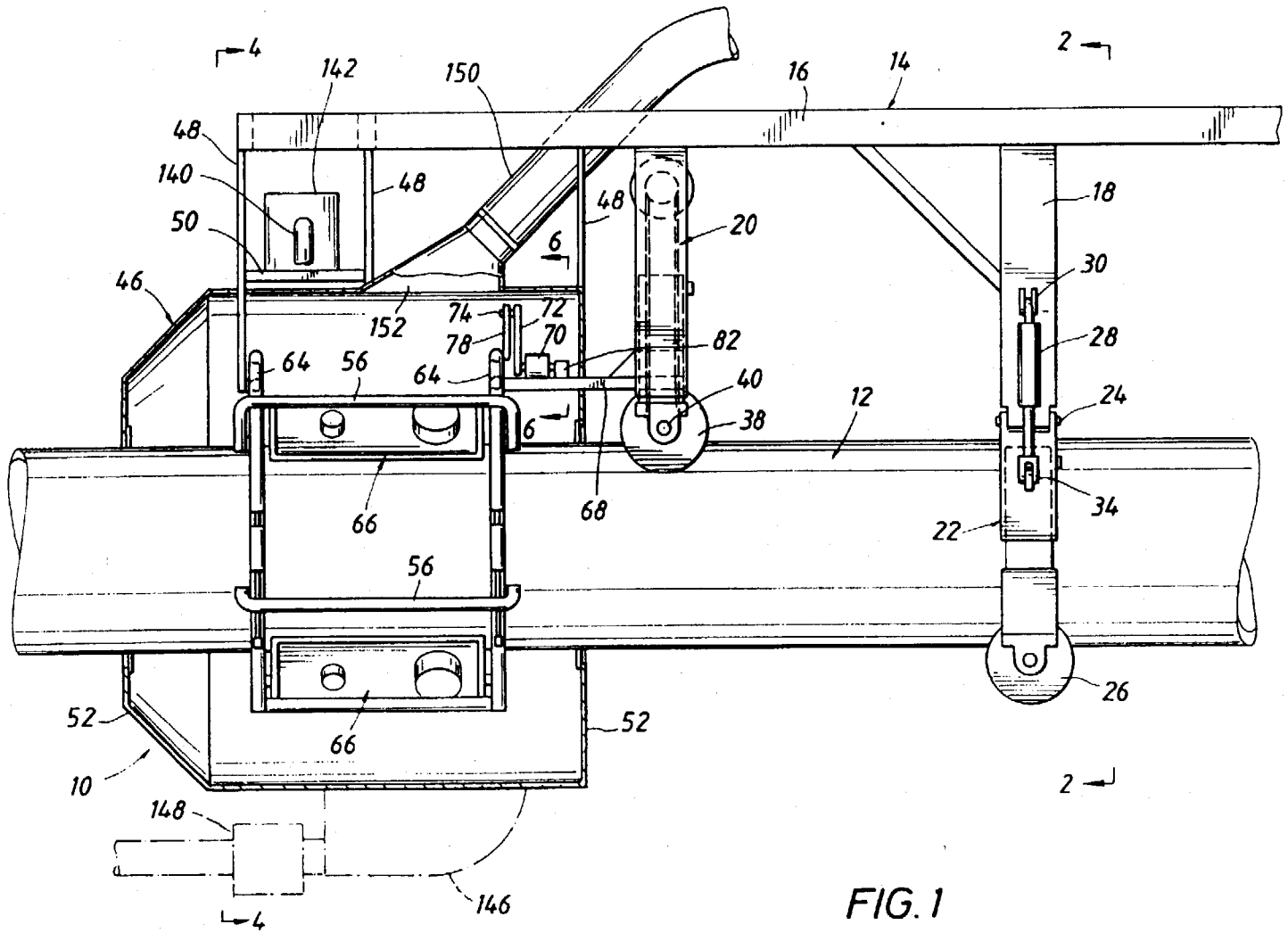
FIG.1 is a side elevation of a self-propelled carriage of the apparatus of this invention on a pipe for longitudinal movement along a pipe.
Figure 2:
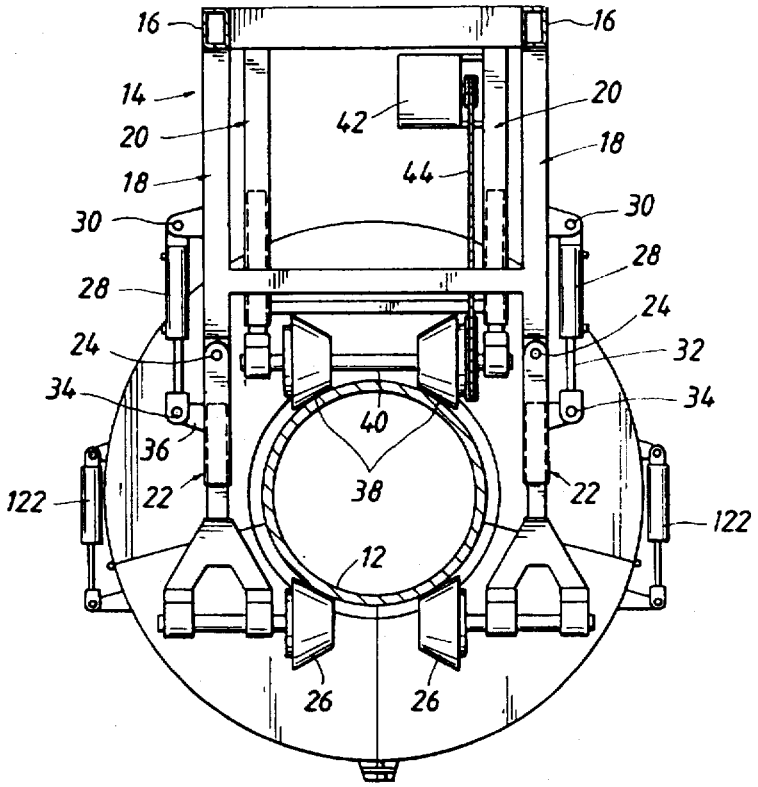
FIG. 2 is an end elevation of the roller support means for the carriage taken generally along line 2—2 of FIG. 1.
Figure 3:
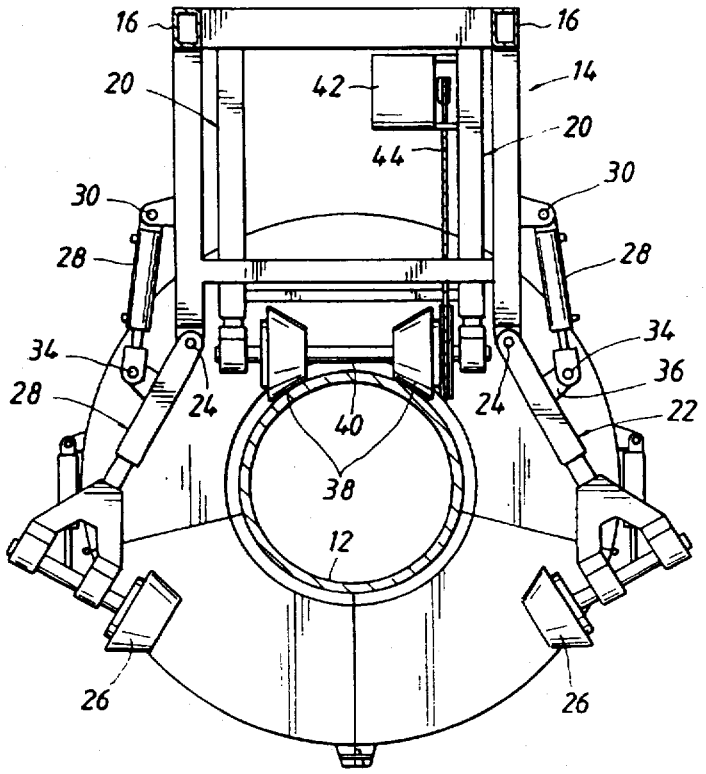
FIG. 3 is an end elevation similar to FIG. 2 but showing pivoted portions of the roller frame pivoted to an outward position for assembly on the pipe.

Referring now to FIGS. 1–9, a self-propelled carriage of the apparatus of this invention is shown generally at 10 supported on the outer periphery of a pipe or pipeline 12 for longitudinal movement along the pipe in a series of short longitudinal steps or distances separated by a time interval or dwell to permit oscillation of nozzles at a stationary position of the carriage to discharge high pressure water jets in an arcuate path concentric to the outer periphery of the pipe for cleaning the outer periphery of the pipe. The pipeline 12 is formed of many joints of pipe welded together to provide a total length of many miles. It is not uncommon for a pipeline to extend over 1,000 miles. While such a long pipeline is primarily a long uninterrupted series of pipe joints welded together, there are spaced interruptions such as pump stations. Even so, this cleaning system 10 can be placed on the pipeline 12 to clean for long stretches. When an obstacle is encountered, the carriage 10 is simply removed and put back together on the pipeline to go around or past the obstacle. Referring particularly to FIGS. 1–3, an upper support frame shown generally at 14 has upper horizontal frame members 16 and downwardly extending front legs generally indicated at 18 and downwardly extending intermediate legs generally indicated at 20. The lower roller frames 22 are pivotally mounted at 24 on the legs 18 and have lower rollers 26 thereon. The hydraulic cylinders 28 pivotally secured at 30 to the legs have piston rods 32 pivotally mounted at 34 to the brackets 36 on the frames 22. The brackets 36 having rollers 26 there on are adapted for adjustment in a vertical direction relative to the upper roller frame 22 to permit adjustment of the rollers 26 for fitting about the pipe 12 of varying diameters. FIGS. 2 and 3 show left and right hand symmetry in the structure 10.

Mounted on the intermediate legs 20 is an intermediate and transverse roller frame having upper rollers 38 thereon fixed to a shaft 40. The rollers may be manually adjusted vertically on the legs 20 to adapt for the pipe 12 of varying diameters. A hydraulic motor 42 rotates the shaft 40 and the rollers 38 thereon via the sprocket chain 44. FIG. 3 shows the lower roller frame 22 pivoted to an outward position for assembly of the carriage 10 on the pipe 12 and for disassembly from the pipe 12. This enables the carriage to go around pipeline related barriers.

A housing generally indicated at 46 is supported by the support frame 14 connected with the downwardly extending legs 48 and the transverse frame member 50 between the two legs 48. The housing 46 includes a pair of end walls 52 having openings receiving the pipe 12. A peripheral wall 54 is between the walls 52 and encircles the pipe 12. The housing 46 defines an enclosed cleaning chamber about the pipe 12 for the discharge of high pressure water jets therein against the outer surface of pipe 12.

Figure 4:
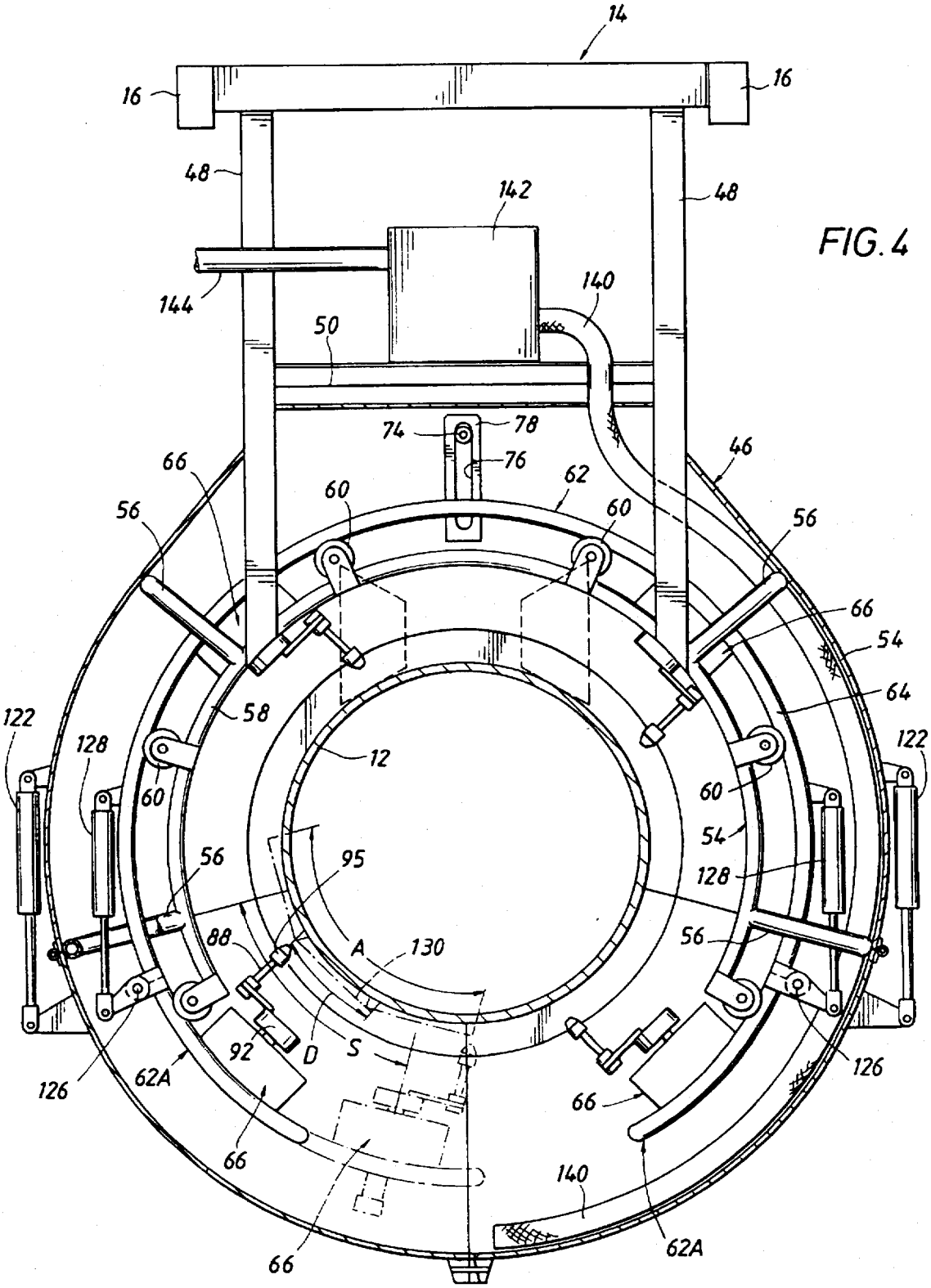
FIG. 4 is an end elevation, partly in section, taken generally along line 4—4 of FIG. 1 showing the carriage releasably secured about the pipe.

A fixed annular support or frame formed of tubular stock within the housing 46 includes a plurality of U-shaped frame members 56 spaced at arcuate intervals on the interior of the peripheral wall 54 of the housing 46 which are anchored thereto. An inner arcuate ring 58 is secured to each leg of U-shaped frame members 56 (see FIG. 4). The rollers 60 are mounted on the ring 58. The arcuate ring 58 has a portion thereof cutaway or deleted at its lower arcuate sufficient to receive the pipe 12 therein to permit the ring 58 to fit fully around the pipe 12. FIG. 4 shows this in detail where the carriage 10 fits over the pipeline 12 and centers the ring 58 concentric around the pipeline 12. The set of rollers 60 define a larger concentric pathway defined below.

A moveable nozzle support frame generally indicated at 62 is mounted on the fixed annular support frame for oscillation. The ring 58 defines a concentric pathway for the larger frame member 62. The frame member 62 is defined by two spaced rings 64 (FIG. 1). The concentric rings 58 and 64 are spaced apart by the tab supported rollers 60. In the preferred version of equipment, the rollers 60 are numerous, perhaps as many as six in FIG. 4, although 12 can be used also. They collectively form a guide surface. The nozzle support frame 62 includes the pair of arcuate rings 64 mounted on the rollers 60 for relative arcuate movements in a path concentric to the outer periphery of the pipe 12. Nozzle subassemblies (shown particularly in FIGS. 7–9) are mounted on a nozzle support frame 62 for oscillating movement with the frame 62. As shown in FIG. 4, four nozzle subassemblies 66 are mounted on the frame 62 spaced at equal arcuate intervals of 90 degrees from each other. Thus, to clean the entire periphery of the pipe 12, the frame 62 must travel 90 degrees. It may be desirable, particularly for cleaning a pipe having a relatively large diameter, such as sixty inches in diameter, to provide additional nozzle subassemblies such as six or eight nozzle subassemblies. More will be noted regarding nozzle assemblies 66 and the nozzle movement more pattern.

Figure 6:
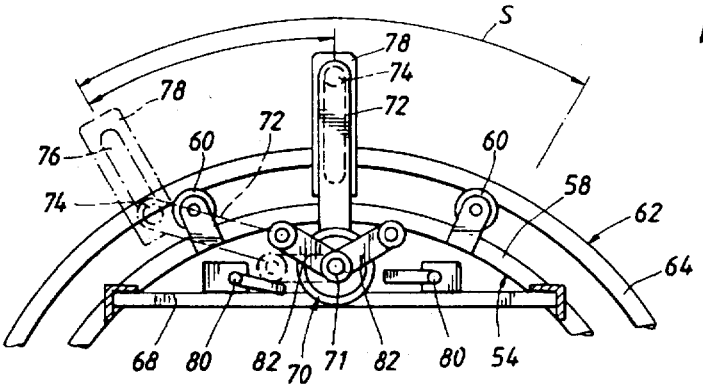
FIG. 6 is a partial end view taken generally along line 6—6 of FIG. 1 and showing means for oscillating the nozzle support frame relative to a fixed support frame.

Referring now to FIG. 6, a mechanism or means for oscillating the nozzle frame 62 relative to the fixed frame member 58 is illustrated. A support plate 68 (also in FIG. 1) mounted between the legs 20 has a reversible hydraulic motor 70 mounted thereon. An arm 72 secured to the shaft 71 has a pin 74 extending into a slot 76 in a link 78 secured to the adjacent ring 64. On rotation of the motor shaft 71, the pin 74 forces the link 78 and frame 62 in one direction. Two limit switches 80 are provided for reversing the motor 70 at the end of a stroke. An arm 82 on the shaft 71 at the opposite end contacts one limit switch 80 at the end of an arcuate stroke for reversing the direction of rotation of the shaft 71 and the nozzle frame 62. The motor 70 moves the arm 72 to enable relative angular movement to the left and right. Specifically, the extreme range of travel is to the dotted line position in FIG. 6 and returns to the symmetrical position of FIG. 6 where both extremes of movement are limited by the duplicate switches 80 at the opposite extremes of movement. By controlling the dimensions of this system including limit switch placement, the angular excursion can be controlled. By controlling motor speed, the angular rate can be controlled.

Figure 7:
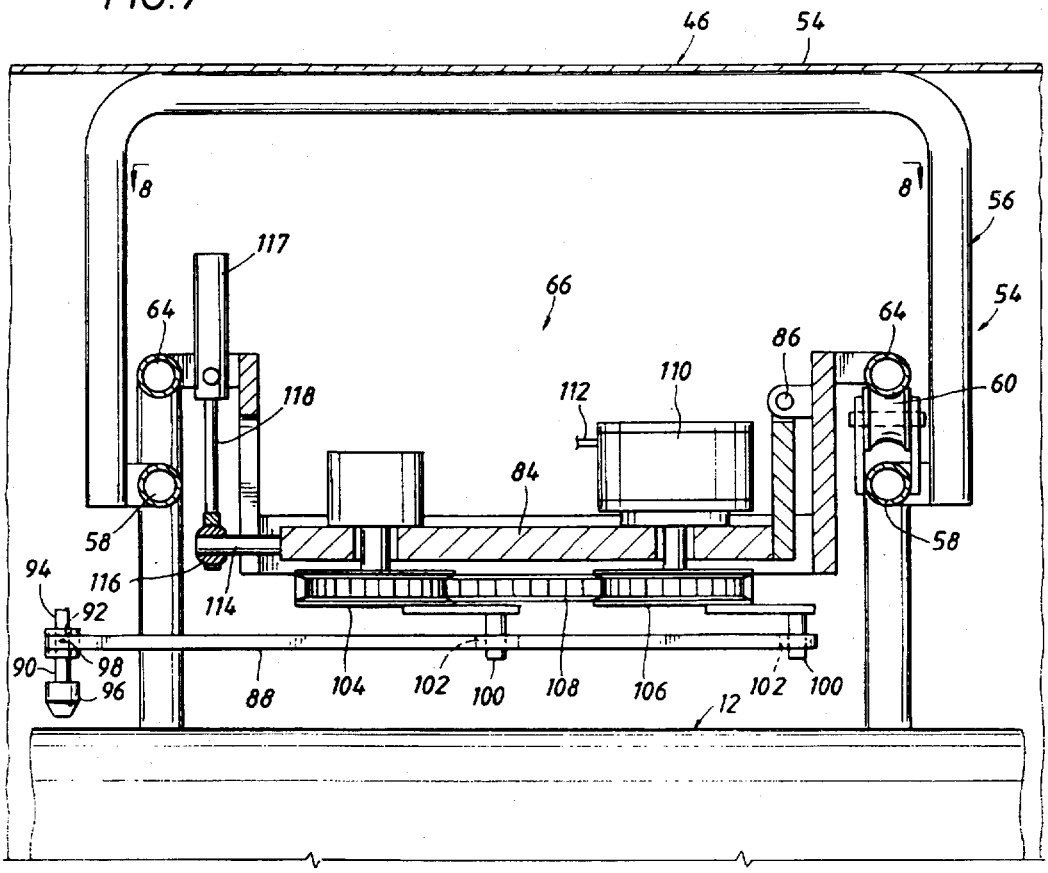
FIG. 7 is a cross sectional view of a nozzle subassembly showing a nozzle mounted for 360 degree rotation and including drive means for rotating the nozzles.
Figure 9:
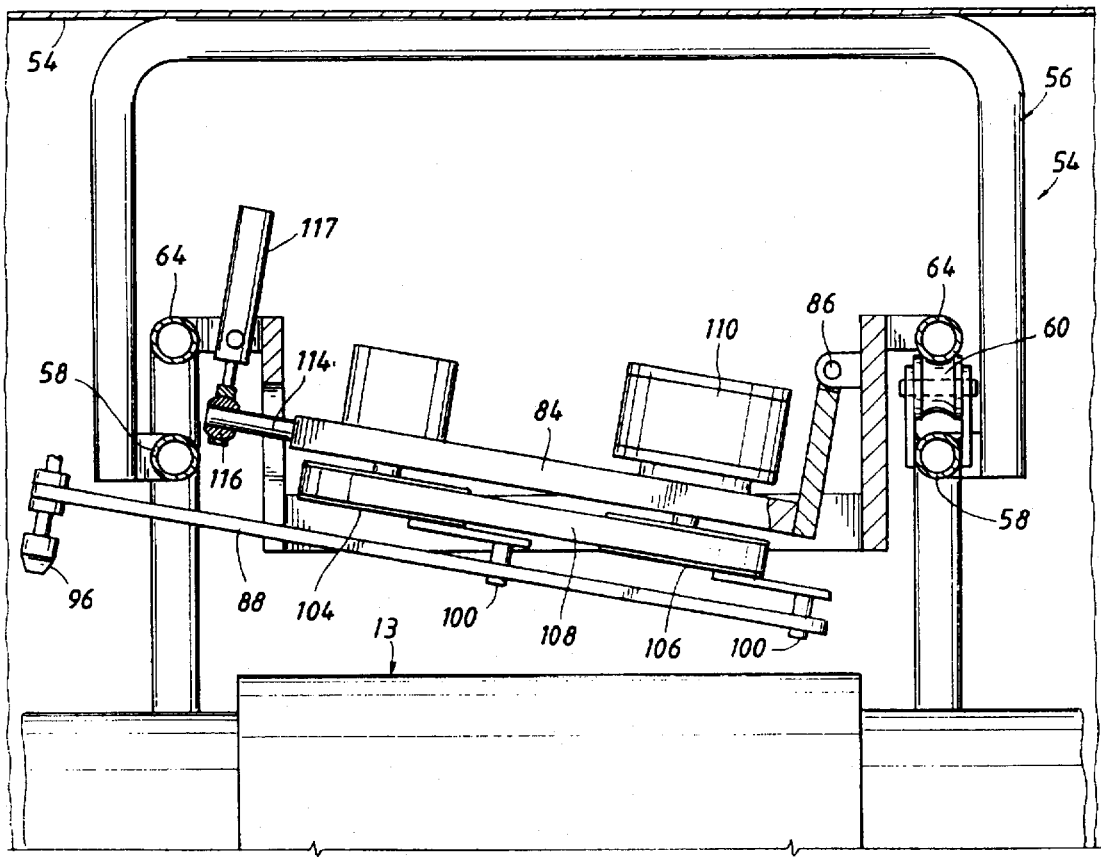
FIG. 9 is a side elevation of the nozzle subassembly shown in FIGS. 7 and 8 showing a subassembly frame mounted for pivotal movement.
Figure 8:
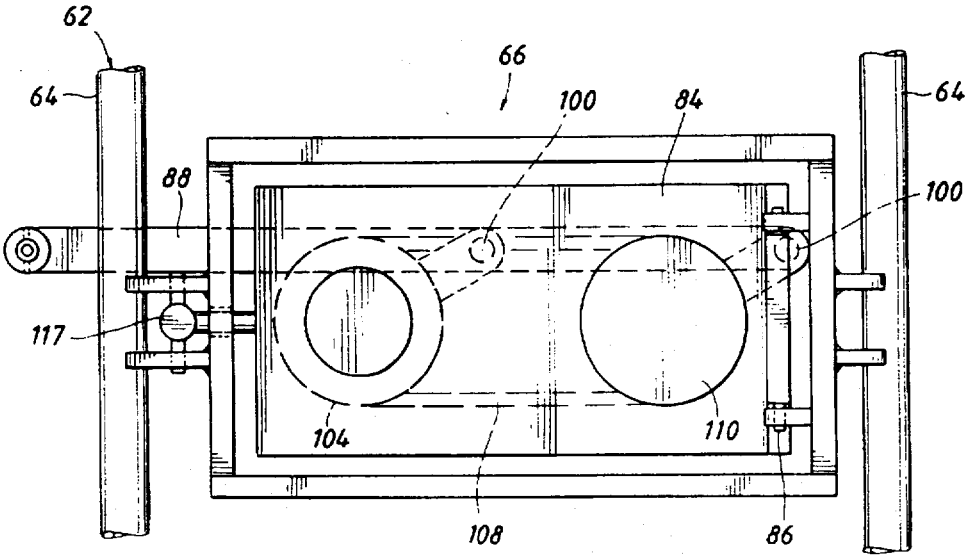
FIG. 8 is a top plan of the nozzle subassembly shown in FIG. 7 taken generally along line 8—8 of FIG. 7.

Referring now particularly to FIGS. 7–9, a nozzle subassembly 66 is illustrated extending between and mounted on the two spaced arcuate rings 64 of the oscillating frame 62. The nozzle subassembly includes a pivoted subassembly frame 84 mounted for pivotal movement about the pivot 86. An oscillating nozzle arm 88 has a rigid nozzle tube 90 extending through an opening 92 in the arm 88. The remote end of the nozzle tube 90 is connected to a high pressure water hose 94 for the supply of pressurized water while the inner end of nozzle tube 90 has a discharge nozzle cap 96 with an orifice of the water jet. The height or clearance of the lower end or orifice of the nozzle tube 90 may be adjusted by a set screw 98 on the arm 88 to vary the distance of the nozzle from the outer surface of pipe 12 which may be, for example, between one-half inch and three inches. The arm 88 is supported for oscillation on the mounting pins 100 mounted in bearings 102 on the arm 88. The upper ends of the two pins 100 are secured for movement driven jointly by an idler pulley 104 and a drive pulley 106. A flexible belt 108 is connected between the pulleys 104 and 106 while the hydraulic motor 110 directly rotates the pulley 106. A flexible hose 112 supplies hydraulic fluid to the motor 110 for the driving motor 110 which repetitively moves the oscillating arm 88 to moves the high pressure water jet from the nozzle tube 90 in a generally circular or elliptical path on the outer surface of the pipe 10. It is noted that a single integral nozzle tube 90 extends through the arm free of seals or other connection. Thus, minimum maintenance is required and any water leakage in minimized even at very high fluid pressures, such as 35,000 psi for example. One important aspect of this disclosed pipe cleaning system is the provision of a seal-less nozzle system featuring a rotating nozzle mounting means. Ordinarily, this would entail a seal connection in the high pressure supply. This seal is exposed to pressures such as 35,000 psi and normally does not last very long. In that event, the seal must be replaced often. In this form of nozzle, especially a moving nozzle, the seal is avoided and therefore the entire high pressure liquid supply will last longer with no service. The duration is extended indefinitely.

The subassembly frame 84 has an extending rod 114 thereon with a swivel 116 on its extending end. As shown in FIG. 9, the pipe 12 has an enlarged diameter portion 13 (such as a joint between adjacent pipe sections). A hydraulic cylinder 117 has a piston rod 118 connected to the swivel 116 for raising the subassembly frame 84 and the orifice in the nozzle cap 96 for passing over an enlarged diameter pipe section 13.

Figure 5:
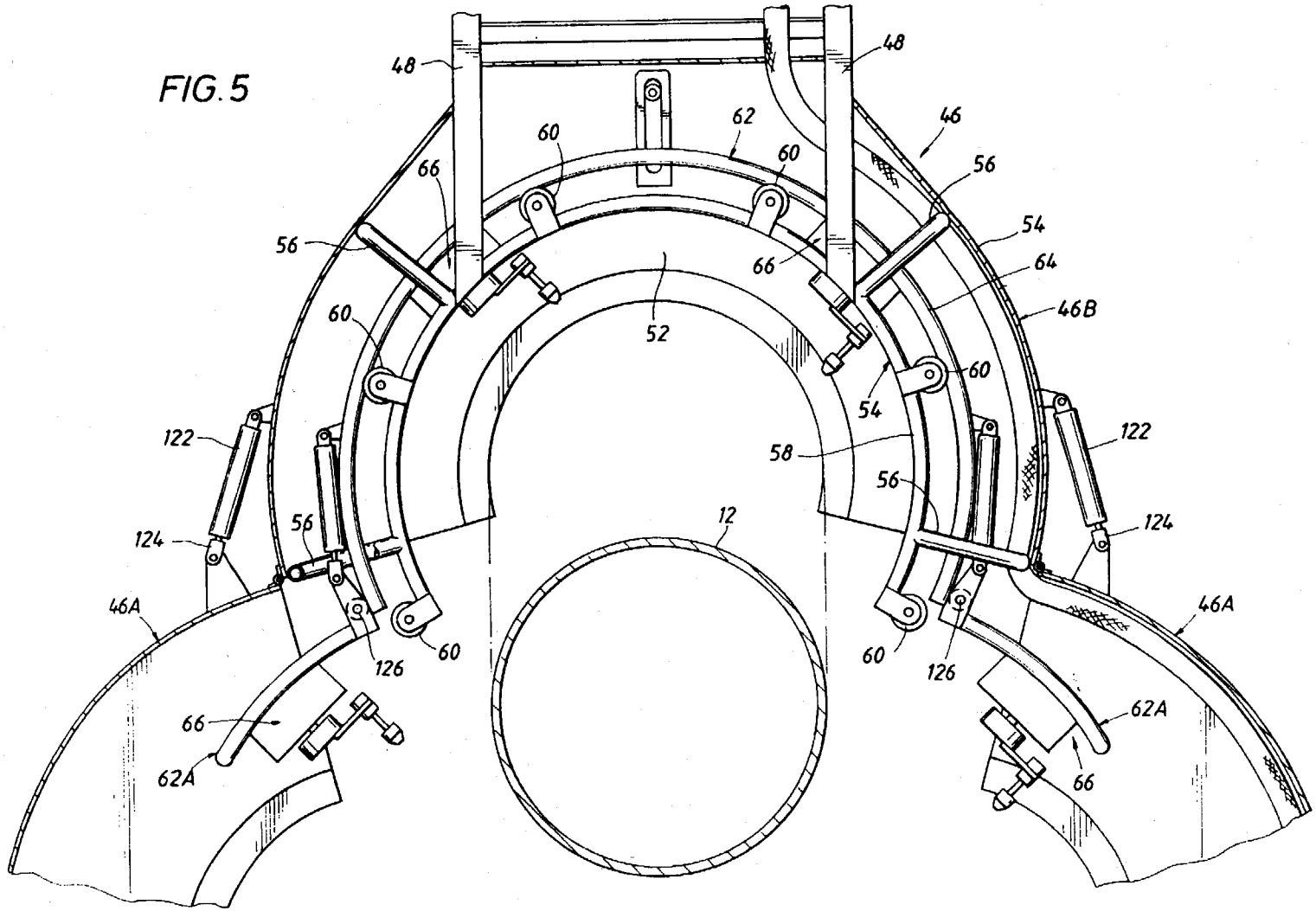
FIG. 5 is an end elevation similar to FIG. 4 but showing pivoted portions of the housing enclosing the pipe pivoted to an open position for assembly on the pipe and disassembly from the pipe.

Referring particularly to FIG. 5, the housing 46 and oscillating nozzle frame 62 are shown for assembly on the pipe 12 and disassembly from the pipe 12. The housing 46 has a pair of facing lower housing sections 46A mounted for pivotal or swinging movement about the pivots 120 on the fixed, upper main housing section 46B. The hydraulic cylinders 122 anchored to the fixed, upper housing section 46B have piston rods 124 connected to the lower sections 46A to swing the housing sections 46A inwardly from the opened position of FIG. 5 for assembly about the pipe 12 (see FIG. 4) and for swinging housing sections 46A outwardly to the position of FIG. 5 for disassembly from pipe 12. Likewise, the nozzle frame 62 has duplicate, pivoted lower sections 62A mounted for swinging movement about the pivots 126. The two hydraulic cylinders 128 have piston rods connected to the two lower frame sections 62A for swinging the sections 62A in and out relative to the pipe 12. Duplicate pivoting housing sections 46A and nozzle frame sections 62A are latched together about the pipe 12 in the assembled position. In the assembled position, the carriage 10 grasps the underside of the pipe 12 to hold the carriage upright.

Referring particularly to FIG. 4, the water jet pattern width is illustrated for a nozzle subassembly 66. The water jet from the orifice in the nozzle 90 (See FIG. 7) transcribes or traces a generally circular or elliptical path on the outer periphery of the pipe 12 as shown by the arc 130 with a cleaning width defined by rotation of, the arm 88 by the motor 110 (See FIG. 7). Since the nozzle frame 62 is oscillating while the nozzles tubes are rotating, a spiral path is provided by the water jets from the nozzle orifice. However, since the nozzles tubes 90 are rotating at a high speed (such as 1,500 rpm), the path transcribed by the water jets appears to be substantially circular or slightly elliptical. When the nozzle tube 90 is closer to the pipe 12, the distance D of the path 130 traced on the outer surface of the pipe 12 remains the same. The total oscillating stroke of the subassembly 66 and the nozzle frame 62 is around 60 degrees as shown at S in FIG. 4 where the inscribed angle of each nozzle subassembly is defined by an oscillating stroke of around 60 degrees. With the nozzle orifice 96 spaced around one inch from the outer surface of the pipe 12, a distance (diameter) D of around ten inches is obtained. While, only four nozzle subassemblies 66 are shown in the drawings for illustration, it is to be understood that additional nozzle subassemblies may be provided, such as five to eight subassemblies. The oscillating stroke S is proportional to the total number of nozzles.

Figure 10:
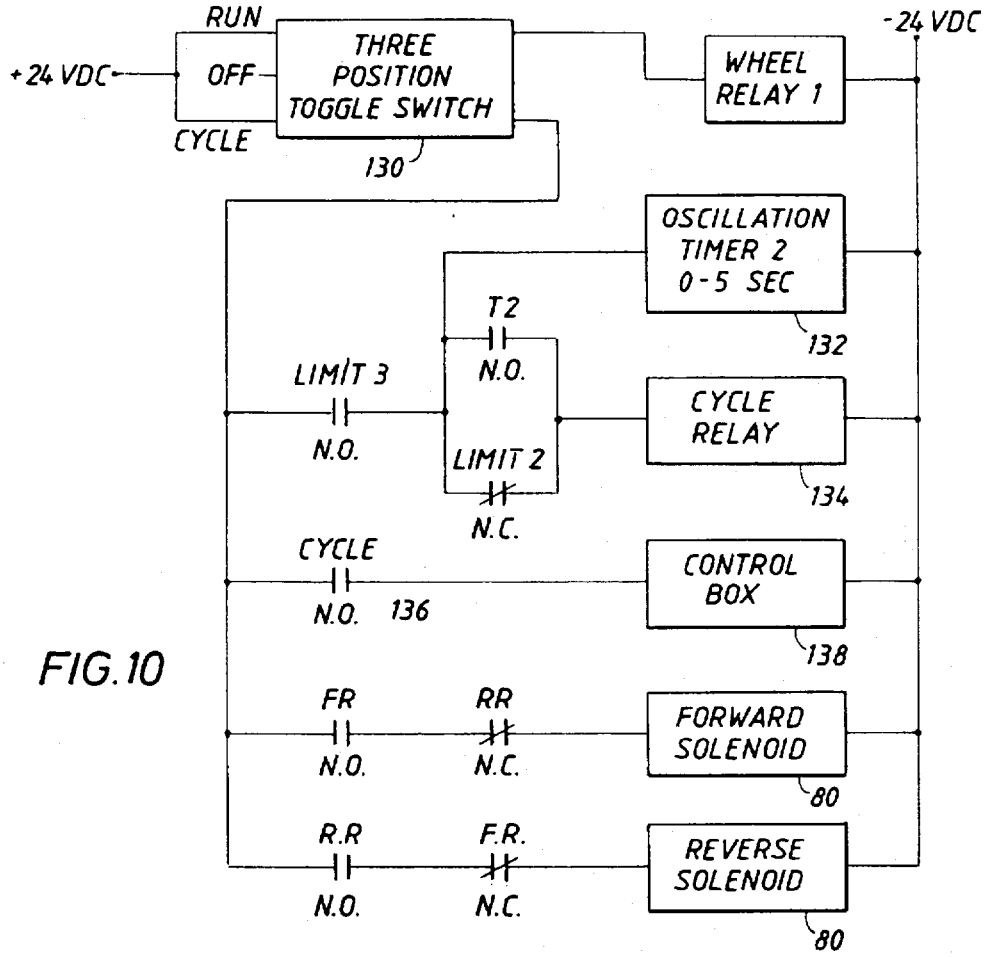
FIG. 10 is a schematic of the control system for moving the carriage longitudinally along the pipe and for oscillating the nozzles separately when the carriage is in a stationary position.
Figure 11:
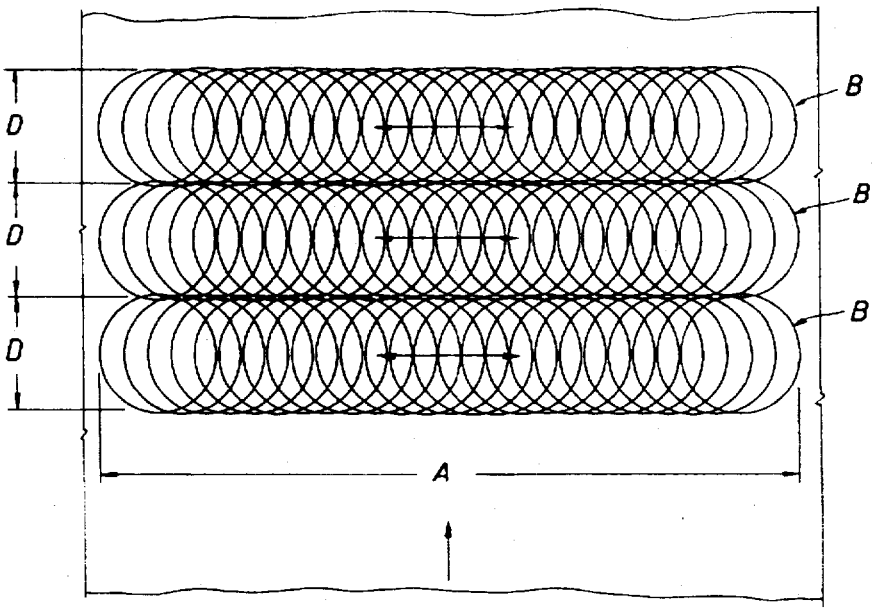
FIG. 11 is a schematic of the pattern transcribed by the high pressure water jets on the outer periphery of the pipeline while the carriage is stopped.

Referring now to FIG. 10, a control system is illustrated schematically for movement of the carriage 10 in a series of steps longitudinally along the pipe 12 with each step being of a distance generally equal to the diameter D. At the end of each longitudinal movement, the nozzle frame 62 is oscillated for an entire cycle with the nozzles 90 directing a high pressure water jet against the outer surface of the pipe 12 from a nozzle tip distance of around one inch. Thus, a generally cylindrical band on the outer surface of the pipe 12 is cleaned having a width generally equal to diameter D derived from the movement of the nozzles. With a complete oscillating cycle, the nozzle orifices 90 pass over the same area of the band B twice (see FIG. 11). With four nozzles tubes 90 as illustrated in the drawings, an arc A on the surface of the pipe 12 of around 90 degrees is covered by each nozzle tube 96. FIG. 11 illustrates schematically the generally cylindrical cleaning bands B provided by the high pressure water jets on the pipe 12 from the nozzle tubes 90 while the carriage 10 is stopped at the end of a longitudinal movement. The control system shown in FIG. 10 is designed to oscillate the rotating jet nozzle tubes 90 around the outer periphery of the pipe 12 while the carriage 10 is stopped. After the oscillating nozzles have made one complete travel movement, the oscillating movement is stopped and the carriage 10 then moves forward another step where it stops for another oscillating cycle. The sequential steps are performed automatically under control by the cycle position of the toggle switch 130 as set forth below.

The three position toggle switch shown at 130 in FIG. 10 selects the mode of operation for the carriage 10. With the toggle switch 130 in the "run" position, the carriage 10 may be moved in a forward or reverse direction determined by rotation of the drive rollers 38 to position the carriage 10 on the pipe 12 for commencing the high pressure water jet operation. In the "run" position, the nozzle frame 62 cannot be oscillated. For automatic cycling with the carriage 10 in position for commencing the cleaning operation, the toggle switch 130 is manually moved to the "cycle" position. In this position, the carriage 10 is moved along the pipe 21 a predetermined distance D such as ten inches and stopped automatically. A timer 132 is then energized for energizing the cycle relay 134 to close the contacts 136 to thereby supply electrical power to the control box 138 and the reversible motor 70 for the oscillation of the nozzle frame 62. The limit switches 80 control the solenoids for reversing of the motor 70 and the nozzle frame 62.

Water and waste coating material removed from the outer surface of the pipe 12 normally falls by gravity to the bottom of the housing 46 which forms a sump for the slurry of water and waste material. Since the waste coating material may contain materials, such as asbestos, which may be environmentally harmful, it is desirable to remove the waste coating material from the water and to collect the material for disposal at a remote disposal site. Also, since relatively large volumes of water are utilized in the treating operation, it is desirable to recycle the water so that a minimum amount of water is utilized for the cleaning operation. Normally, a water tank truck is positioned alongside a pipe cleaning machine 10 when high pressure water jets are utilized for cleaning pipe and such a tank would not be necessary with the present invention because the water. As shown particularly in FIG. 4, for example, a vacuum hose 140, having an open end which forms a, discharge opening placed in the housing 46, extends to the bottom of housing 46 and a vacuum pump 142 draws the slurry of water and entrained waste material through an outlet hose 144. If desired, a separate sump 146 as shown in FIG. 1 could be provided as an integral part of the housing 46 and a vacuum pump 148 could be attached to the sump. Also, a positive pressure pump in place of a vacuum pump could be utilized for the removal of the water and entrained waste coating material, if desired. Further, as shown particularly in FIG. 1, a forced hot air conduit is shown at 150 for the supply of hot air to the interior of the housing 46 through an opening 152. When the cleaning apparatus of the present invention is utilized in frigid areas such as Alaska, it is desirable to provide hot air to the interior of housing 46 to or minimize any freezing of water, particularly on the outer surface of the pipe 12. Suitable vents may be employed in the housing 46 for the release of hot air from the housing 46.

Figure 12:
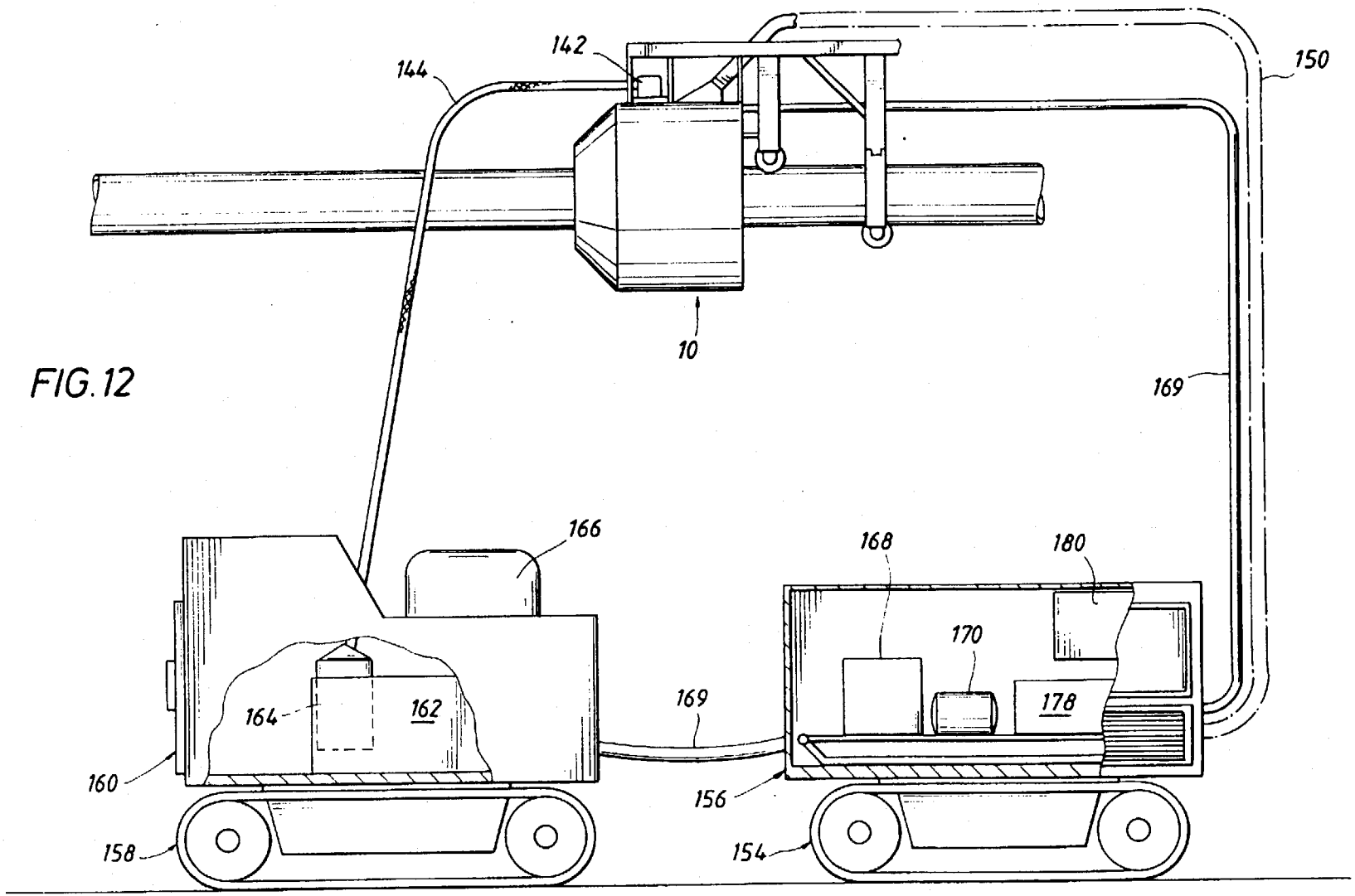
FIG. 12 is a schematic of the apparatus of the present invention showing means for the supply and continuous recirculation of water to the carriage and for separating and collecting the removed material from the pipe.

Referring to FIG. 12, the water recirculation system, including means for filtering and collecting the removed waste coating material entrained with the water, is illustrated schematically. For supporting the pipe 12 above the ground, a front side boom tractor 158 is shown having a platform 160 thereon. A water reservoir 162 having a capacity of around 1,500 gallons for example is supported on the platform 160. The reservoir 162 has a four stage filtration system for removing the waste coating material returned through the hose or conduit 144 from the vacuum pump 142. The filtered waste material is collected in bags or the like for disposal at a separate disposal facility. As the water for cleaning the pipe is under a very high pressure, such as 35,100 psi, for example, the water has a temperature of around 150° F. to 160° F. when returned to the reservoir 162. A cooling tower shown at 166 for the reservoir 162 cools the water to around 90° F. for return to the carriage 10. The cooled water from the reservoir 162 is returned to the carriage 10 through a return line 169 by the pump 168 driven by a diesel engine 170. A hydraulic pump 172 is also driven by the diesel engine 170 and supplies hydraulic fluid from reservoir 174 through a line 176 to the carriage 10 to supply hydraulic fluid to the hydraulic motors 42, 70, 110 and the hydraulic cylinders 28, 117, 122, and 128. In the event warm air is utilized, an air compressor 178 is driven from the diesel engine 170 and a heater 180 is provided for heating the air for supply through the line 150 and opening 152 into the interior of the housing 46. When utilized in sub-freezing temperatures, the lines from tractors 154 and 158 to the carriage 10 may be insulated.

Figure 13:
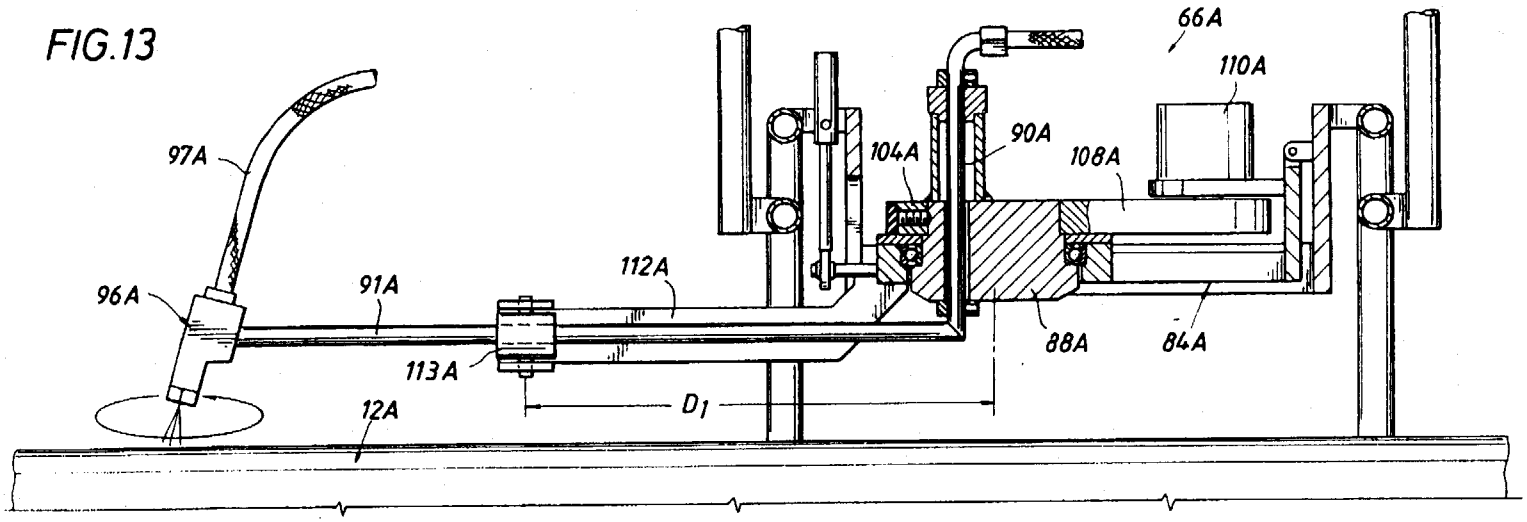
FIG. 13 is a side elevation, partly in section, of another modification of a nozzle subassembly in which the nozzle head is adapted to receive an abrasive material for entrainment in the high velocity water jet.

Another embodiment of this invention is shown in FIG. 13 in which a nozzle subassembly 66A is illustrated having a nozzle 96A adapted to receive an abrasive material from the hose 97A for entrainment in the high velocity water jet for discharge against the outer surface of the pipe. The nozzle tube 90A extends through a spindle head 88A mounted on the frame 84A for oscillation without the utilization of any seals therebetween. Hydraulic motor 110A drives a pulley 104A from the pulley belt 108A for rotation of the spindle head 88A. An elongate, laterally directed bracket 112A extending from the frame 84A carries a pivotally mounted sleeve 113A which receives right angled portion 91A of the nozzle tube 90A in sliding relation for the supply of high pressure water to the nozzle 96A. Abrasive material, such as sand metal grit or bicarbonate of soda, for example, is entrained with the high pressure water in the nozzle 96A for discharge in a high pressure jet against the outer surface of the pipe 12A. The high pressure water jet transcribes or traces a generally circular or elliptical path in a spiraling pattern. The diameter of the transcribed path is determined by the distance $D_1$ between the rotational axis of the spindle head 88A and the pivotal axis of the sleeve 113A. A decrease in the distance $D_1$ provides an increase in the diameter of the generally elliptical path transcribed by the water jet. The size of the transcribed path may also be varied by the spacing or distance between the discharge orifice of the nozzle 96A and the outer surface of pope 12A. A spacing of around one inch from the pipe 12A has been found to be satisfactory for high pressures such as 35,000 psi for example. Spacing between about one-half inch and about three inches have been found to provide satisfactory results.

Figure 14:
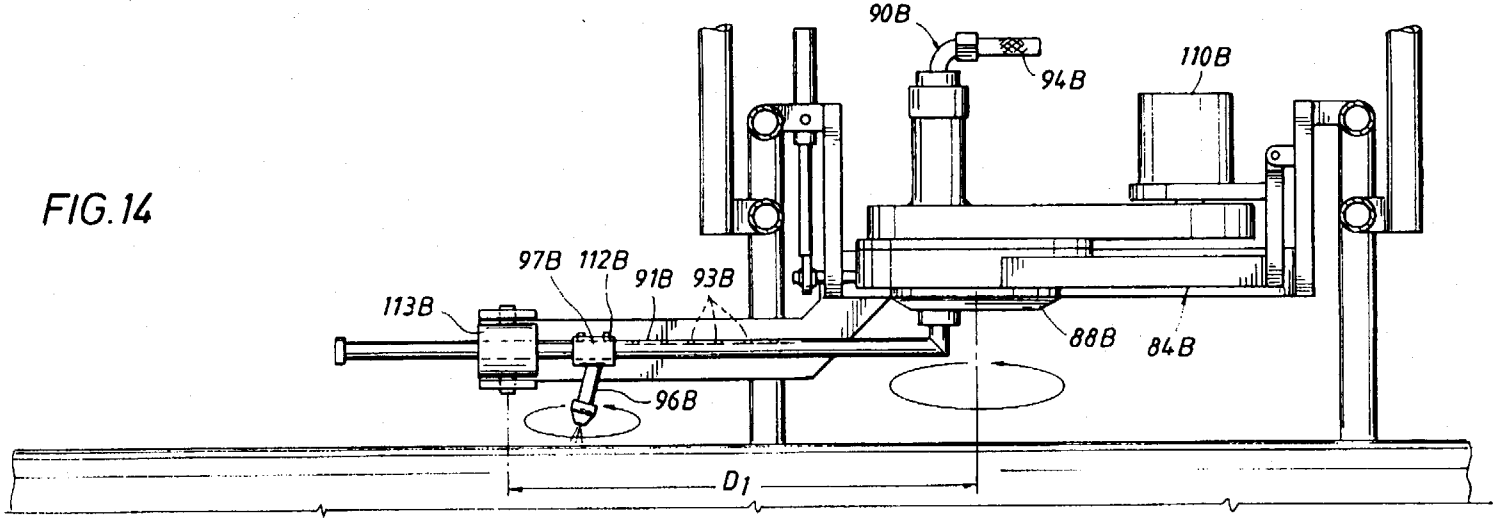
FIG. 14 is a side elevation of a modified nozzle subassembly in which the nozzle is mounted for adjustment in a direction along the longitudinal axis of the pipe.

Referring to FIG. 14, a further modification of this invention is illustrated in which a nozzle subassembly has a nozzle 96B mounted for longitudinal adjustment along right angled portion 91B of the nozzle tube 90B for the supply of high pressure water from the hose 94B. A spindle head 88B is mounted for rotation on the frame 84B and is driven by hydraulic motor 110B as in the embodiment of FIG. 13. The bracket 112B extending from the frame 84B has a pivotally mounted sleeve 113B thereon and nozzle rod portion 91B is mounted in the sleeve 113B for sliding movement. The shape and size of the pattern or path transcribed by the water jet discharged from the nozzle 96B may be varied by distance $D_1$ between the rotational axis of the spindle head 88B and the pivotal axis of the support sleeve 113B in addition to the position of the nozzle rod portion 91B. To permit adjustment of the nozzle 96B along the rod portion 91B, the rod portion 91B has a plurality of longitudinally spaced ports 93B thereon which are plugged. A slidable sleeve 97B is secured by set screws on the rod portion 93B and may be adjusted over a desired port 93B at the desired location along the rod portion 93B.

ALTERNATIVE NOZZLE MECHANISM

Attention is now directed to FIGS. 15, 16 and 17 considered jointly which show an alternate nozzle arrangement which is generally indicated by the numeral 200. This construction utilizes a framework 201. The frame incorporates an upstanding end 202 which is supported for pivotal movement on a pair of perforated alignment tabs 203 shown in both FIGS. 15 and 16. The tabs 203 define an axis of rotation. Moreover, the frame member 202 supports an L-shaped mounting bracket 205 which serves as a motor support for an electric or hydraulic motor 206. The motor 206 has a rotatable shaft extending downwardly below the bracket 205, and the shaft is keyed or otherwise attached to a rotatable pulley 207. The pulley 207 engages a belt 208 which is rotated at a speed and with sufficient power to provide nozzle rotation.

As further shown in the drawings, the belt 208 extends around a pulley 210 as shown in FIG. 17. The pulley 210 is conveniently axially hollow to reduce weight. Moreover, the pulley supports an upstanding nozzle pipe 211 which connects through an elbow 212 with a flexible hose 213. The hose 213 extends to a pump of the sort described above and it delivers a spray liquid at high pressure, using the pump as mentioned and operating at the pressures exemplified above. Moreover, the hose 213 is deployed in such a location that it does not tangle with the belt drive or the pulleys which are below the hose. The nozzle pipe 211 is of sufficient length that it extends downwardly through the pulley and also through a bearing plate 215, see FIG. 17. The bearing plate 215 is conveniently bolted to the pulley 210. These two plates rotate together in unison. Moreover, the bearing plate 215 includes a countersunk opening to receive a nozzle bearing assembly 216 so that the nozzle pipe 211 can relatively rotate. As will be understood, it oscillates during rotation of the pulley 210 but does not rotate through a full revolution because it is tethered to the line 213 which limits rotation to oscillatory movement of less than one revolution. The nozzle pipe 211 is locked with a collar 219 at the top end and a similar collar at the bottom end. These two collars clamp the nozzle pipe so it does not rise or fall. The nozzle pipe can be raised by loosening these two collars which are provided with set screws for that purpose. Thus, the position of the nozzle can be raised and lowered by adjustment of the location of the nozzle in vertical movement with respect to FIGS. 15 and 17. The nozzle pipe 211 supports the nozzle assembly 222 at the lower end.

The bearing plate 215 includes an outer shoulder 223 which supports a bearing assembly 224. The bearing assembly is held by a fixed external ring which in turn is welded or otherwise attached to the frame member 225 in FIG. 17. The frame member 225 connects as part of the frame supporting the entire assembly shown in FIGS. 15–17 inclusive. In summary, this assembly is rotated at a speed determined by the motor 206. It rotates the nozzle tip 222 in a circular locus. The height of the nozzle assembly 222 is determined in the fashion just described so that it can be positioned near a work surface as required.

Figure 18:
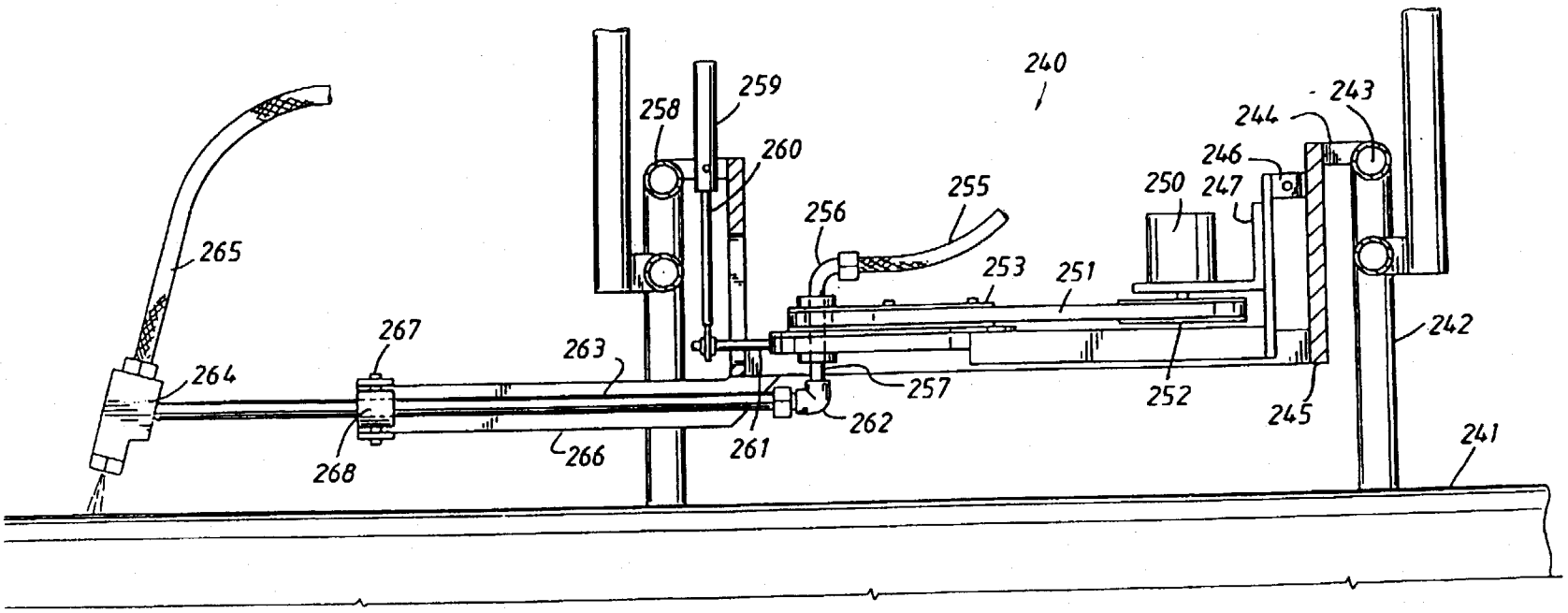
FIG. 18 is an enlarged view of a nozzle supported on an elongated lever which is rotated by a rotating mechanism similar to that shown in FIG. 15 and further incorporating means for converting the rotary motion at one end of the lever into motion at the opposite end of the lever.

Going now to an alternate embodiment, attention is next directed to FIGS. 18 and 19 where the nozzle embodiment 240 will now be described. It is shown in this instance with a supportive frame member 241. That frame member includes an upstanding post 242. It supports a horizontal frame member 243 which incorporates a protruding tab 244 thereby extending horizontally and connecting with a vertical mounting plate 245. The mounting plate is included so that the nozzle assembly pivots about an axis of rotation through the mounting tabs 246. There are two such tabs deployed in the same fashion as the tabs 203 shown in FIG. 15 and 16. Similar to FIGS. 15 and 16, there is an upstanding L-shaped mounting bracket 247 which supports a motor 250, and the remainder of the frame equipment is identical to that shown in FIGS. 15–17 inclusive. As before, the motor drives a flexible belt 251. It passes around the drive pulley 252 and rotates the nozzle pulley 253. As before, the nozzle is connected in a water flow system which utilizes the hose 255 connecting with an elbow 256 and then connecting with a nozzle pipe 257. The motor 250 creates circular motion for the nozzle pipe 257. Additional support is provided by a frame 258, but the frame 258 supports the entire nozzle assembly. Nozzle elevation is occasioned by application of hydraulic power through suitable hydraulic flowlines (not shown for sake of clarity) to a hydraulic cylinder 259, the cylinder 259 operating an extending piston rod 260 which connects with an anchor rod 261. The rod 261 enables the frame and nozzle assembly to be pivoted about the pivot point extending through the tabs 246.

The nozzle assembly 240 is different in that rotational motion from the nozzle pipe is converted into a projected circle, i.e. an ellipse. Structurally, it is accomplished by simply extending the nozzle through an elbow 262 connecting with an extender pipe 263. The extender pipe extends outwardly to a nozzle head 264. The nozzle head 264 is connected with another line 265. The line 265 extends to a blast material source. In the event that a blast material is supplied, the blast material is mixed with the nozzle head 264 and water delivered through the line 255 is used to provide the liquid carrier.

Recall that the embodiment 200 has a frame which supports the drive motor and the two pulleys which are involved in nozzle rotation. That frame is extended by incorporating an arm 266 which at its distal end has a clevis supporting a pivot rod 267. The pivot rod provides a moveable pivot mounting for a sleeve 268. The sleeve 268 fits loosely around the nozzle extender pipe 263 to permit sliding movement.

Figure 19:
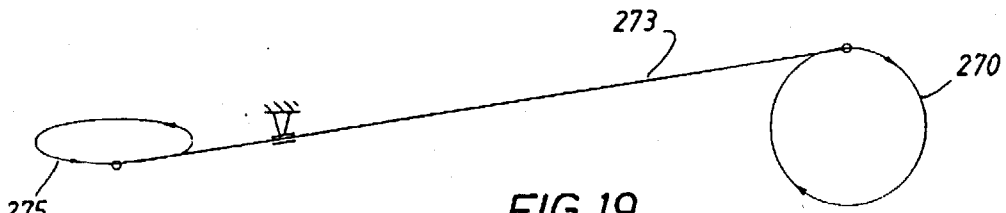
FIG. 19 is a geometric representation of the motion of the levers shown in FIG. 18 and further illustrating a locus of the nozzle.

Going now to FIG. 19 of the drawings, the nozzle pipe 257 traces the circle 270. The extender pipe 263 defines the fixed length shown in FIG. 19 by the numeral 273. The ellipse 275 is traced by the remote end of the extender pipe 263, and this pivoted slide and long pipe converts circular motion into an ellipse. The ellipse has a major axis equal to the diameter of the circle while the minor axis is defined by the relative location of the sleeve which serves as a pivot point in rotational movement which is converted to reciprocating movement of the extender pipe 263 to form the ellipse.

Figure 20:
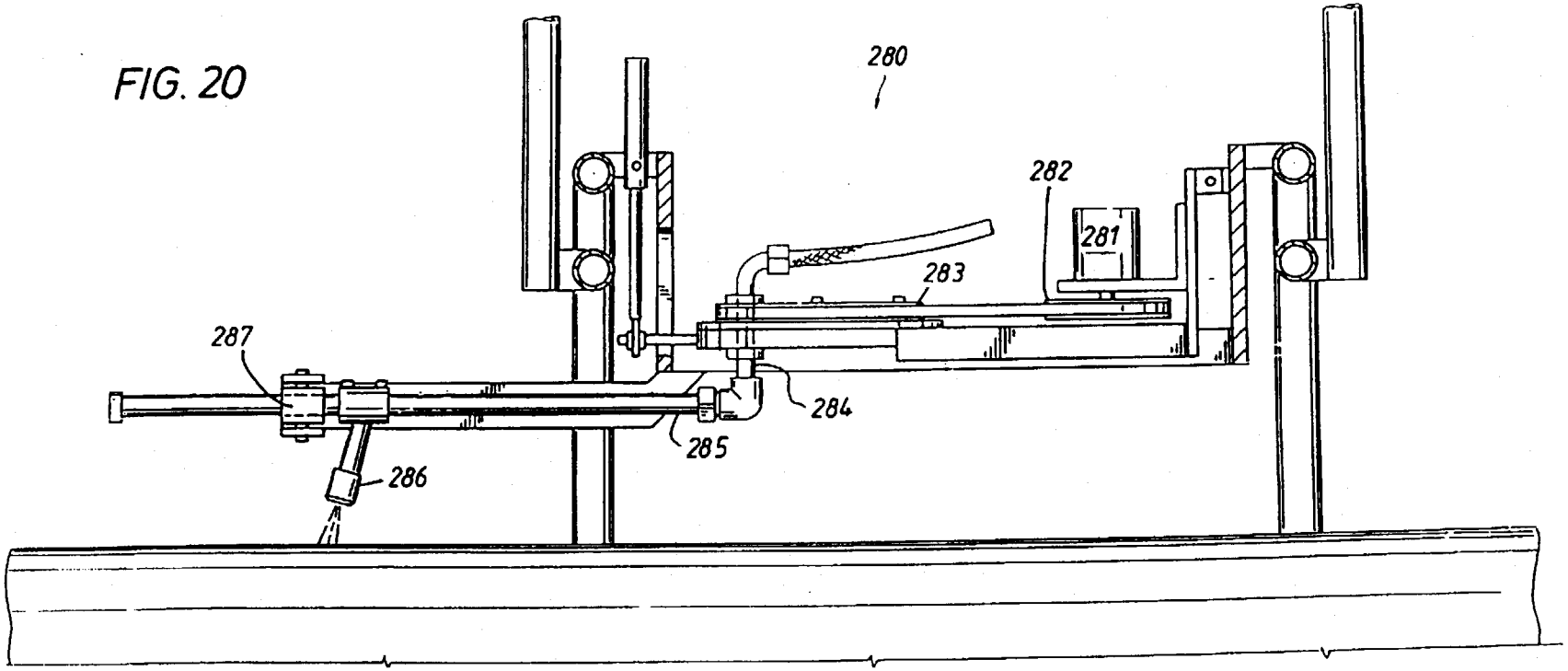
FIG. 20 is a view similar to the rotating nozzle mechanism shown in FIG. 18 showing an alternate form of the lever where the nozzle is rotated in a oval or elliptical pattern contrasted with a circular pattern.
Figure 21:
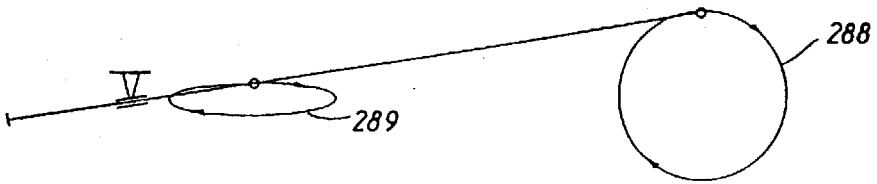
FIG. 21 is a view similar to FIG. 19 showing the patterns of movement derived from the circular motion imparted through a lever to a nozzle moving in an elliptical pattern.

Attention is now directed to FIGS. 20 and 21 which show an alternate embodiment identified generally at 280. As before, it utilizes a similar framework as shown in FIG. 18 to support the assembly. Moreover, this includes a motor 281 which connects to a drive pulley 282 and rotates the pulley 283. A nozzle pipe 284 again is included. An extender pipe 285 functions in the same manner as the extender pipe 263 just mentioned. The extender pipe 285 supports a nozzle head 286. In this instance, the nozzle head 286 is located on the right hand side of a mounting sleeve 287 which permits pivotal movement of the extender pipe. Going now to FIG. 21 of the drawings, circular motion is identified at 288 and is similar to that circular motion obtained with the prior embodiment and geometrically represented in FIG. 19 of the drawings. In FIG. 19, the ellipse is at the left side of the pivot. Here, it is on the right hand side of the pivot point defined by the sleeve. This embodiment differs in that the sleeve 287 functions as a pivot point for oscillatory reciprocating motion. The frame deploys the sleeve in the same fashion, and the rod is able to reciprocate through the sleeve 287. The reciprocating extender pipe does not position the nozzle at the remote or distal end; rather, it is on the same side of the pivot. As shown further in the FIG. 21, the ellipse 289 is constrained in its minor dimension so that it makes a different sweep in contrast with that accomplished heretofore.

The motor driven pulley connected directly to the nozzle tube causes rotation in a circle. A projection of the circle to points along the straight line (a pipe connecting to a nozzle tube) causes elliptical patterns shown in FIGS. 19 or 21 because it defines a locus of points deployed in an ellipse. The width of the ellipse can be varied to meet specific needs as will be discussed below.

FIGS. 19 and 21 show a geometric representation of the linkage which connects with the nozzle tube which is rotated in a circle. Circular motion is obtained by the drive mechanism that includes the illustrated hydraulic motors or equivalent power plants driving a pulley. Geometrically speaking, pulley motion is circular. In the embodiments shown in FIGS. 18 and 20, the nozzle tube does not connect directly with the nozzle where the nozzle rotates in a circle. Rather, the nozzle tube connects through an elbow extending to the side through an elongate pipe which is represented as a straight line in FIGS. 19 and 21. The geometric representation of these two views shows how the straight line (meaning the laterally extending elongate pipe) extends to a remote pivot point where sliding motion is permitted through the linear bearings, thereby imparting repetitive motion to the respective nozzles. Dependent on the situation, the nozzle installed along the laterally extending pipe is moved in an ellipse in both illustrated situations but the relative dimensions of the ellipses are different. More specifically, they are different in that the relative sizes of the major axis and minor axis of the respective ellipses are altered. Suffice it to say, by appropriate dimensional adjustments to the two embodiments shown in FIGS. 18 and 20, it is possible to arrange an ellipse where the major axis is parallel to the axis of the pipeline 12 or at right angles to the pipeline. In other words, the operator has several options available at the time of use in the field by adjusting the position of the jet orifices with respect to the rotating equipment.

Figure 23:
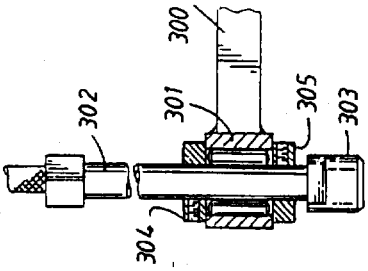
FIG. 23 is a sectional view through a shaft showing a bearing assembly and suitable stop collars around the shaft which enables rotation.
Figure 22:
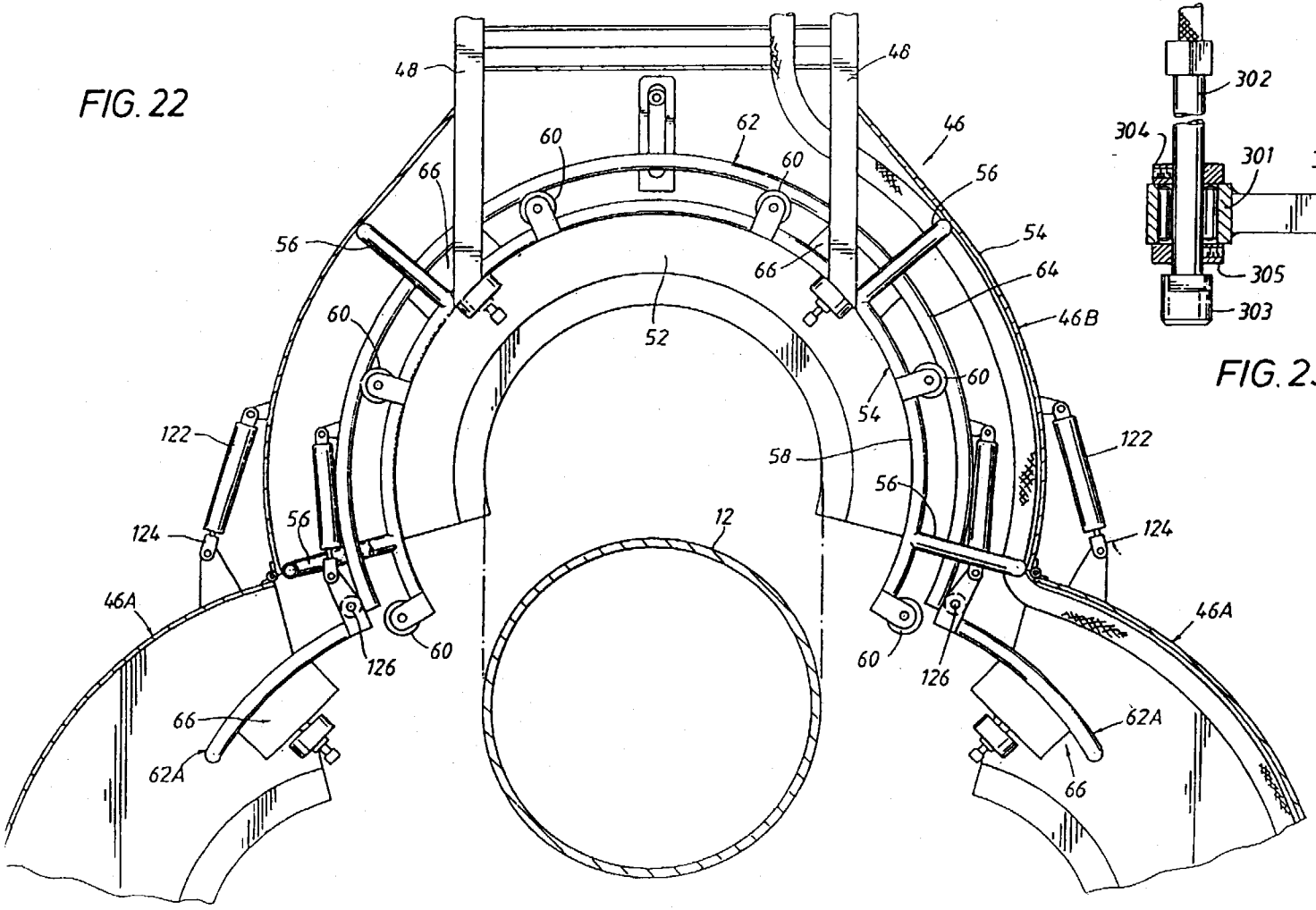
FIG. 22 is a view through the apparatus similar to that shown in FIG. 5 of the drawings.
Figure 28:
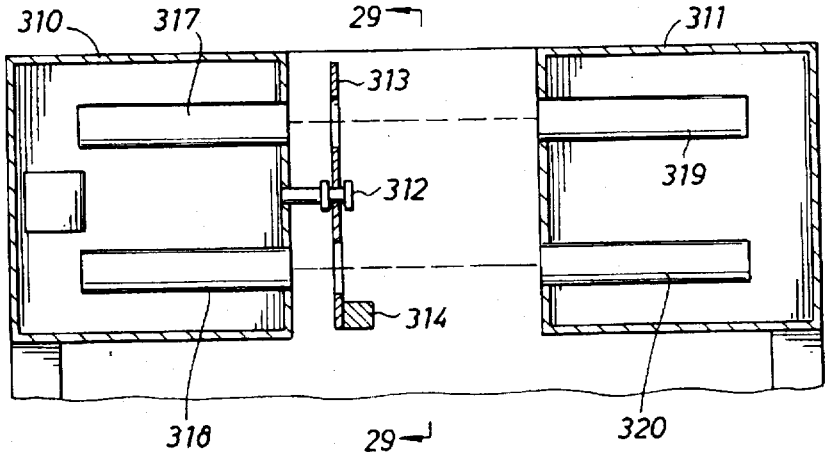
FIG. 28 is a detailed view showing alignment of light sources and photoelectric cells which enable alignment of equipment on the pipe.

Attention is now directed to FIG. 22 of the drawings. FIG. 22 is relatively similar to FIG. 5 previously mentioned. Because of that fact, reference numerals which identify common parts in the embodiment of FIG. 5 are likewise applied to the construction shown in FIG. 22. FIG. 23 shows a construction of a nozzle and in particular shows a supportive frame member 300 which includes a cylindrical ring 301 at its end. The ring 301 encloses a bearing assembly to assure easy rotation for a nozzle pipe 302. The nozzle pipe 302 connects with a nozzle head assembly 303 at the lower end. Vertical adjustment of the nozzle is accomplished by such screw latching of lock rings 304 and 305. They can be released and moved along the nozzle to change the relative height of the nozzle.

ALTERNATIVE CARRIAGE DRIVE SYSTEM

Attention is now directed to FIGS. 24–31 inclusive which describe in some detail an alternative carriage drive system. Recall that the carriage must travel along a pipe joint which is normally assembled in a pipeline. Further, the pipeline has substantial length. This type of equipment is often required to be used on a pipeline to clean miles of the pipeline. To accomplish this, sometimes it is necessary to unearth the trench adjacent to the pipeline. Once access to the pipeline is obtained and once lateral clearance is obtained in the ditch, the present equipment is mounted on the pipeline to ultimately clean the exposed length of pipe. This requires that the equipment travel on the pipeline in a fashion assuring that the entire surface is cleaned. The emphasis with regard to FIGS. 24–31 relates to the guidance or control system. It is not directed to the nozzle support or power assembly which controls the several nozzles mounted on the pipeline in the assembly. Rather, the construction of the equipment which will be emphasized in the discussion, is directed to the control mechanism which assumes that the nozzles for cleaning purposes are identical to the construction exemplified in FIG. 22. For that purpose, the alternate embodiment 300 which is shown in FIG. 24 incorporates a housing 301 which encloses the nozzle apparatus shown in FIG. 23. That apparatus is pulled along the pipe 12 to clean the pipe on the exterior in the same fashion as other embodiments. The housing 301 is connected with a bracket 302 which extends forwardly of the structure. It supports a mounting bracket or arm 303 which in turn supports a drive motor 304. The drive motor provides power to a drive wheel 305, the motor being connected directly with the wheel by means of a direct shaft connection. The motor and wheel are supported on the bracket just mentioned and they are positioned so that the outer surface of the wheel 305 is contacted against the pipe with sufficient frictional engagement to assure adequate traction to thereby drive the equipment along the pipeline 12. The equipment normally moves at a steady rate of speed. When it is moving in a forward direction along the pipeline, the speed is relatively uniform. This requires that the drive wheel 305 rotate at a relatively fixed rate of speed. Moreover, the drive wheel 305 shown in FIG. 24 is preferably replicated with a duplicate drive wheel 305 on the opposite side. As shown in FIG. 25, the two drive wheels are located so that they contact the pipeline 12 near the upper portions. All of the weight of the carriage is supported so that substantial weight is applied to the two drive wheels and traction is assured. There are additional wheels at 306 shown in FIG. 25, but these two wheels are not driven. Rather, they are idler wheels which assure alignment and which limit wobble. They also help limit canting of the equipment to a narrow range with respect the center line axis of the pipeline.

Going now to FIGS. 26 and 27, it will there be observed that the entire mechanism is at a canted angle of a few degrees with respect to the center line axis of the pipeline. More specifically, this illustrates a canted angle of just a few degrees, perhaps in the range of five or six degrees. The canted angle is overcome by the construction of the present equipment. The several drive wheels direct the carriage along the pipeline with, motion in the form of a helix.

Going back to FIG. 24 of the drawings, the numeral 310 identifies a cabinet which encloses certain equipment for maintaining the carriage 300 in a true pathway along the pipeline 12. It is cooperative with another cabinet 311 spaced from it. The two cabinets cooperate in a fashion which will be described. More importantly, both control the drive motors 304. The drive motors normally, operate at a common speed. The speed is fixed or common so long as the device is tracking upright on the pipeline. When the device moves at an angle so that it is moving in a helix, it is necessary to restore it to the centered pathway. In comparison of FIGS. 24 and 25 which show the device properly aligned and viewing FIGS. 26 and 27 which show the device moving at a canted angle, the apparatus of the present disclosure restores the carriage 300 to the upstanding position. Understanding of this can be obtained by relating the function of the cabinets 310 and 311. This is particularly brought out in FIGS. 26 and 27 where the cabinets 310 and 311 are again shown once the device is not centered. In particular, misalignment as suggested by these views, takes advantage of the gravity vector to move the device back to the centered position. An understanding of this will be obtained in FIGS. 28–31 considered jointly.

Figure 29:
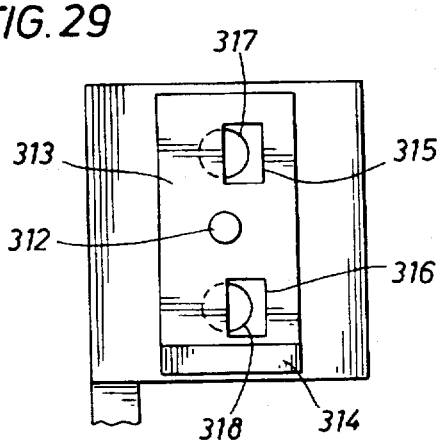
FIGS. 29 and 30 show different views of the shutter between the light sources and the photo cells of FIG. 28 so that alignment is achieved.
Figure 30:
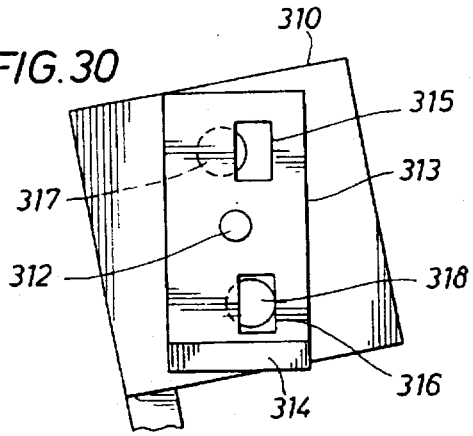
Figure 31:
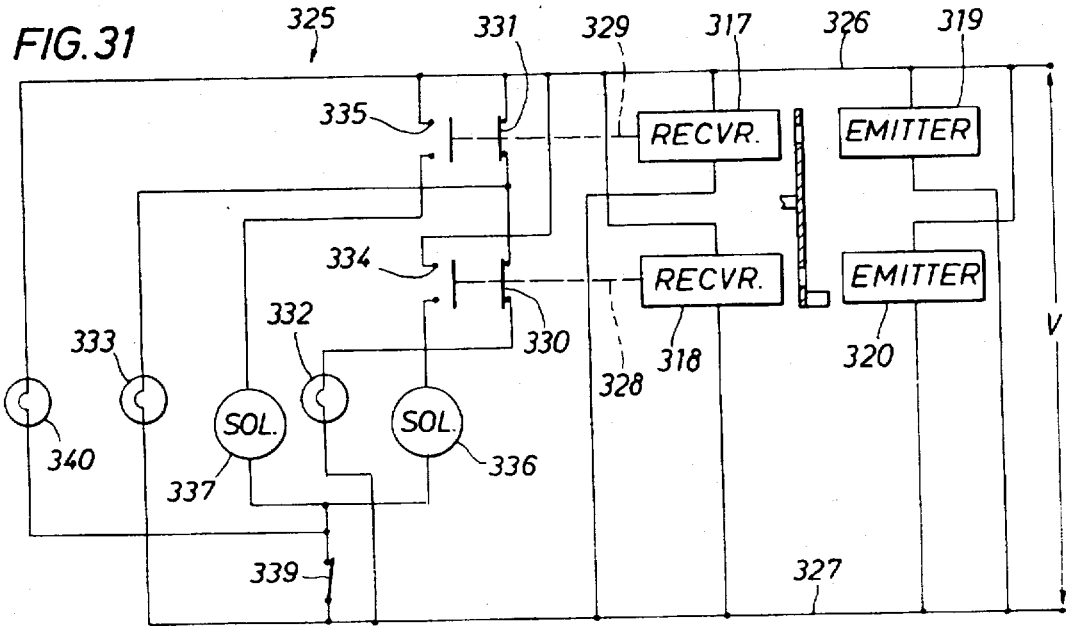
FIG. 31 is a schematic wiring diagram showing the apparatus of FIGS. 28–30 in greater detail.

The cabinet 310 supports a mounting shaft 312 on its forward face and a shutter 313 is positioned on it. The shutter is free to rotate. Because it is fairly long and also provided with a weight 314 at the bottom end, it follows gravity and stays erect with respect to gravity. It is constructed with two openings or ports 315 and 316. The port 315 is positioned over a photocell 317, and a similar photocell 318 is positioned opposite the port 316. The ports cooperate with light sources 319 and 320 which are both located in the cabinet 311. There is a clear pathway so that light from both light source 319 and 320 can be received by both light responsive mechanisms 317 and 318. Note that FIG. 29 shows the ports where the light sensors 317 and 318 receive equal portions of light. By contrast, FIG. 30 shows a change in angular position. Note that the cabinet 310 has been canted by an angle which is related to the tilt of the apparatus. The weight 314 maintains the shutter 313 in the vertical position defined by gravity. Here, the amount of light on the two sensors 317 and 318 is not equal. This creates a signal for a control circuit which is shown in FIG. 31. At this point, the motors are driven with different signals so that one motor will rotate faster that the other and restore the apparatus to the upright position. When the cabinet 310 advances the entire carriage moves to an upright position, and the shutter 313 is restored to the position shown in FIG. 29, thereby providing equal optical input signals to the sensors 317 and 318.

Going now to FIG. 31 of the drawings, it shows an electrical system where a control voltage is applied to a wire 326 which is provided with a ground 327. The two lights 319 and 320 are also included. They transmit light to the sensors 317 and 318. Those provide control signals for operation of relays. Thus, both the sensors 317 and 318 are provided with relay controls. Each therefore is connected to a set of contacts which are operated by the relay connections. This is indicated at 328 where the dotted line extends to a set of relay contacts. In like fashion, a similar dotted line 329 indicates the companion and duplicate connection with a set of contacts. Both relays are identical and the contacts are identical. Therefore the signal voltage on the conductor 326 is provided through one set of contacts 330 to provide a signal at a lamp 332 indicating that the motor is not on. The relay contacts 330 are normally closed while the relay contacts 334 are normally open. In turn, they connect with solenoid 336 which then is operated to control the drive motor side or the other of the carriage 300. In like fashion, the relay contacts 331 correspond to the relay contacts 330, and provide a signal to a lamp 333. The normally open contacts 335 provide a suitable signal to the solenoid 337 which provides control power to the opposite motor. For operator convenience, a master control switch 339 is also included and closure of that switch provides an operator signal at the lamp 340.

Summarizing, the apparatus shown in FIGS. 24–31 controls duplicate motors. The motors are driven evenly when both are on. Should they track unevenly thereby causing the carriage 300 to rotate either to the left or to the right, gravity causes the shutter 314 to move. This is sensed by the control system shown in FIG. 31, and that forms control signals which are output for timed control of both motors. It will switch one on while the other is switched off. There is a centered position where both motors are simultaneously on. As will be understood, the motors are intended to operate simultaneously and they are intended to provide equal thrust to the carriage. Fortunately, this system provides centering which restores the carriage as it gradually moves to the wrong position and restores it to the right upstanding position.

PLANAR SURFACE CLEANING DEVICE

Figure 32:
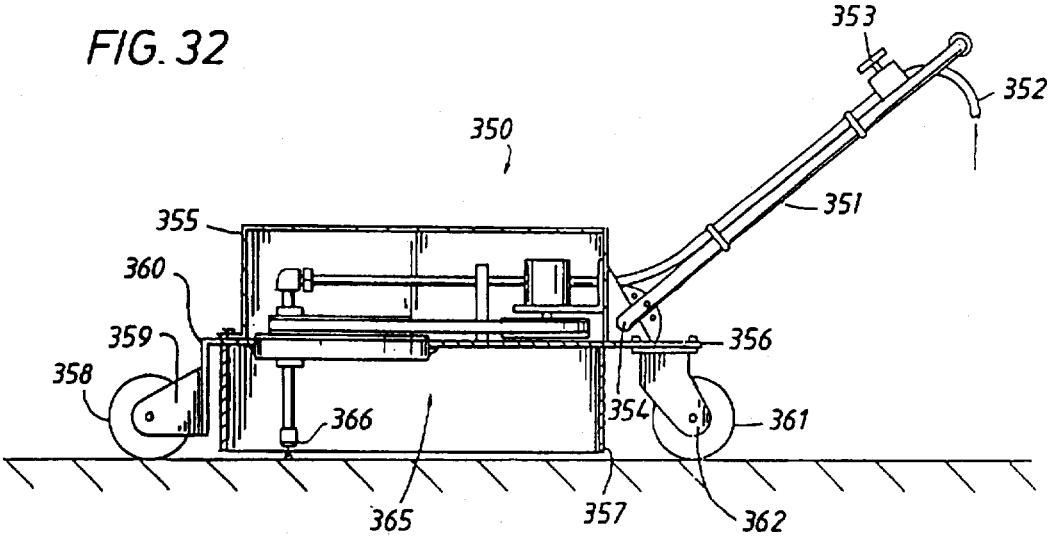
FIG. 32 is a side view of an alternate embodiment of the present apparatus wherein the housing has been partly broken away to show details of construction of the apparatus.
Figure 34:
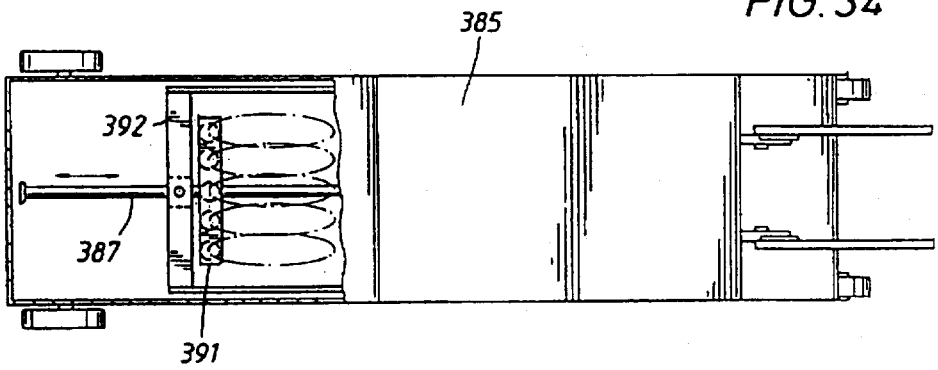
FIG. 34 is a sectional view along the line 34—34 in FIG. 33 showing details of construction of the nozzles on the interior of the housing and the mechanism by which they are moved.
Figure 33:
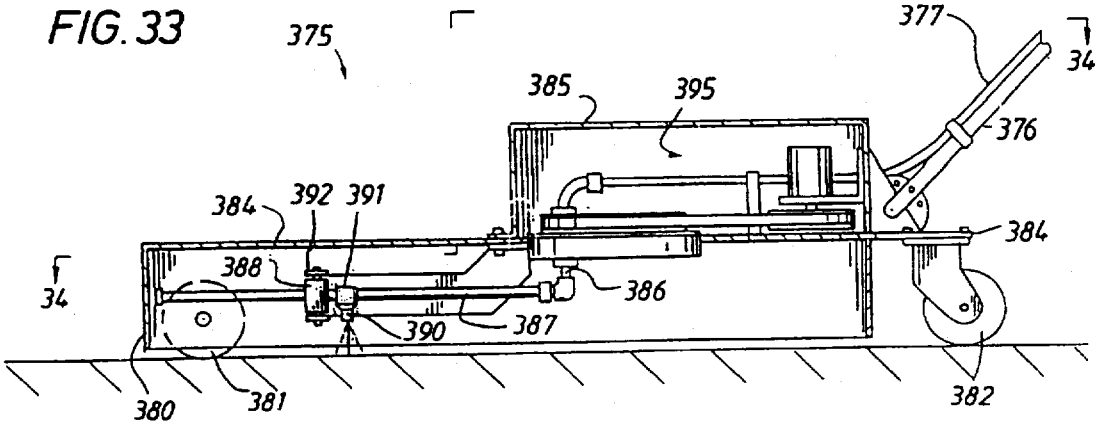
FIG. 33 shows an alternate embodiment to FIG. 32 wherein the housing is substantially longer to support rotating nozzles.

Attention is now directed jointly to FIGS. 32–34 which show a planar surface cleaning mechanism. Going specifically to the embodiment 350 shown in FIG. 32 of the drawings, it is constructed for hand operation. It is therefore scaled so that it is not excessively heavy for an individual to operate. More importantly, it is constructed with an extending handle 351 which is similar to lawn equipment, and there is a high pressure water feed line 352 which extends to a remote high pressure pump (not shown). The water is delivered through a control valve 353 for the operator. The handle bar 351 can be canted to a different angle by its pivotal connection 354 which can be adjusted. The apparatus 350 incorporates a housing 355 which covers a nozzle mechanism which will be described. The housing is typically closed on all sides and the top. It affixes to a transverse mounting plate 356. A lower shroud or housing 357 is appended to the lower side of the mounting plate 356 and serves as a splash guard. It is a surrounding skirt about the area where the cleaning occurs. The mounting plate 356 supports an adequate set of rollers. A typical arrangement positions two rollers on the forward end and two on the back end of the equipment. A typical roller 358 is mounted on a protruding tab 359 which extends forwardly from a mounting bracket 360 attached to the mounting plate 356. Preferably, duplicate front wheels are included at the left and right. The wheels are independently rotatable. Assuming that the weight is not excessive, the cleaning apparatus is hand powered by the user. Similar rear wheels 361 are also included and they are supported on appropriate mounting brackets 362.

The numeral 365 identifies the nozzle apparatus in the interior. The rotating mechanism is located above the mounting plate 356. The nozzle extends through the plate to locate the nozzle tip 366 just above the surface which is to be cleaned. One such nozzle rotating mechanism is exemplified heretofore in other parts of this disclosure, and that includes the representative nozzle mechanism shown in FIGS. 15–17 of the drawings.

Going now to FIG. 33 of the drawings, an alternate embodiment is illustrated. In this embodiment, the surface cleaning apparatus 375 is relatively long. Again, it is hand powered and is provided with the operator handle 376 which extends to the rear. A high pressure water line 377 is likewise included. This particular embodiment is constructed with a rectangular skirt 380 which fully encircles the nozzle area thereby confining splash and preventing unintended intrusion from the exterior. This particular version of equipment again is supported with four wheels at 381 and 382, it being noted that there are duplicate wheels on the opposite side of the apparatus. The particular embodiment 375 includes a deck plate 384 which is rectangular in shape. The plate 384 extends to the rear and provides a point of connection for the mounting brackets for the rear wheels. It also serves as a support for a housing 385 which covers the rotating mechanism for the nozzle. More particularly, the rotating mechanism is the type shown in FIGS. 15–17.

In FIG. 33, the nozzle pipe 386 extends downwardly to an elbow and connects with an extender rod 387. The rod 387 passes through a sleeve 388 which permits reciprocating motion. This embodiment supports a nozzle 390, but the nozzle is supported on a transverse bar 391. This bar is better shown in FIG. 34 of the drawings to be an elongate bar which supports several nozzles arranged transversely across the structure. The sleeve 388 is mounted for rotational movement on a transverse frame member 392. The frame member 392 is located a spaced distance from the end of the shroud 380 so that the extender pipe 387 is permitted to reciprocate with motion forwardly and rearwardly. Moreover, that motion is also accompanied with angular deflection so that the transverse nozzle bar 391 moves the several nozzles in a pattern which is controlled by the rotative motion from the nozzle drive mechanism 395. The nozzle drive mechanism, previously defined and described in detail imparts motion to the several nozzles 390 mounted on the bar 391.

The embodiment 375 operates in a similar fashion of the embodiment 350. Both are hand propelled by the user. Both require connection of a water feed line to a remote pump. Both also utilize the rotary mechanism illustrated in FIGS. 15 to impart rotation to a nozzle so that rotary motion is accomplished. As stated previously, the rotary motion is converted into elliptical motion as represented in FIG. 34. Moreover, the device is able to clean a wider swath.

Figure 35:
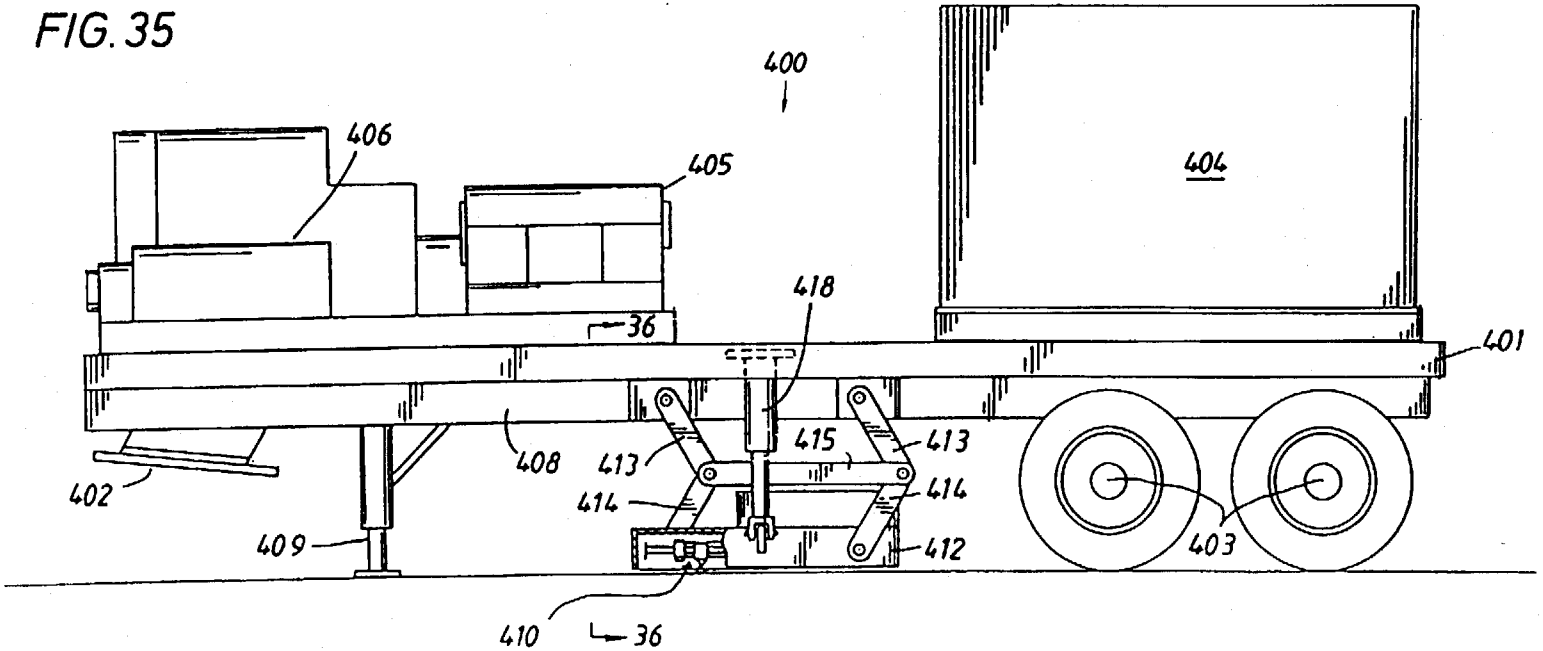
FIG. 35 is a side view of a truck mounted system.
Figure 36:
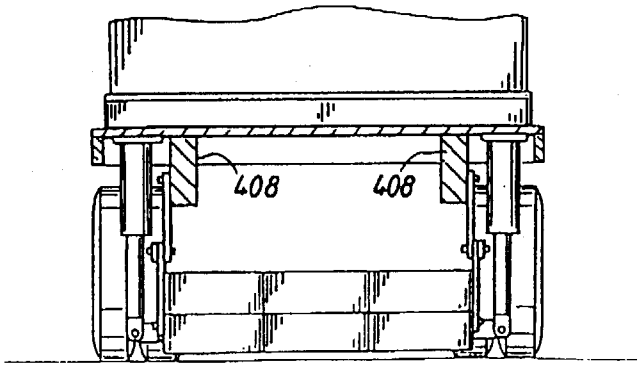
FIG. 36 is a sectional view along the line 36—36 in FIG. 35 showing details of construction of equipment beneath the trailer bed so that a cleaning apparatus is extended for operation therebelow.

Going now jointly to FIGS. 35 and 36, a much larger version of the apparatus is illustrated. The embodiment is trailer mounted and is identified by the numeral 400. This very large set of equipment is mounted in a trailer 401 which is equipped with a fifth wheel 402 to enable connection with a tractor (not shown). It is provided with tandem axles at 403. On the trailer, a large water storage tank 404 is included. The numeral 405 identifies a prime mover such as a diesel engine which is connected with suitable water handling equipment including a pump at 406. The pump is connected by means of hidden water lines. More specifically, the trailer is constructed on a pair of long frame members 408 which extend the length of the trailer and serve as structural support for the equipment. The frame members provide an anchor point for a stationary jack 409 used when the equipment is parked. Moreover, a cleaning mechanism 410 is incorporated beneath the trailer and is constructed in a fashion to be described and is enclosed within a rectangular housing 412. The housing 412 is supported for vertical movement by means of a linkage 413 comprising an upper link, a lower link 414 and a transverse link 415. The upper and lower links are replicated at four corners of the shroud 412. On each side, the horizontal link 414 provides the illustrated connection on that side. Through the use of a hydraulically powered downwardly extending cylinder 418, the cleaning apparatus 410 can be retracted to a raised position. This is done utilizing duplicate left and right hydraulic cylinders 418. They extend appropriate piston rods as illustrated which connect by means of a pin connection to a protruding tab utilizing a clevis at the end of the piston rod. This is duplicated left and right so that the cleaning apparatus is raised evenly. A hydraulic pump and set of hydraulic lines (not shown) is connected to the hydraulic cylinders 418 to operate in parallel.

The apparatus shown at 400 is particularly advantageous for cleaning large paved areas where a water supply is not readily available. The large tank 404 enhances device mobility. Moreover, it can be towed in a cleaning pattern over the area to assure proper cleaning.

Figure 38:
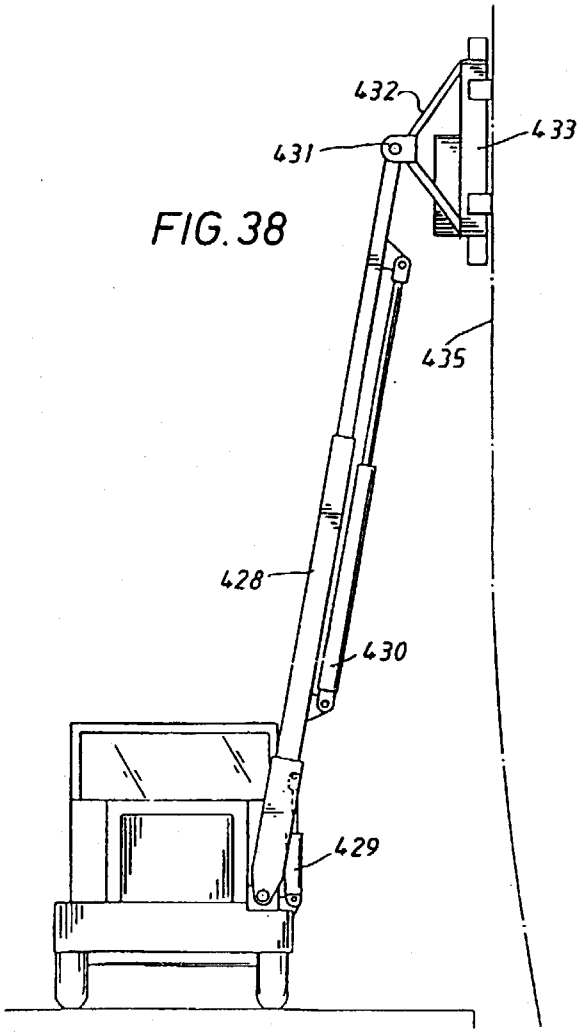
FIG. 38 is a front view of the truck shown in FIG. 37 further showing details of construction of the extended cherry picker which provides apparatus in accordance with the present disclosure at an elevated location.
Figure 37:
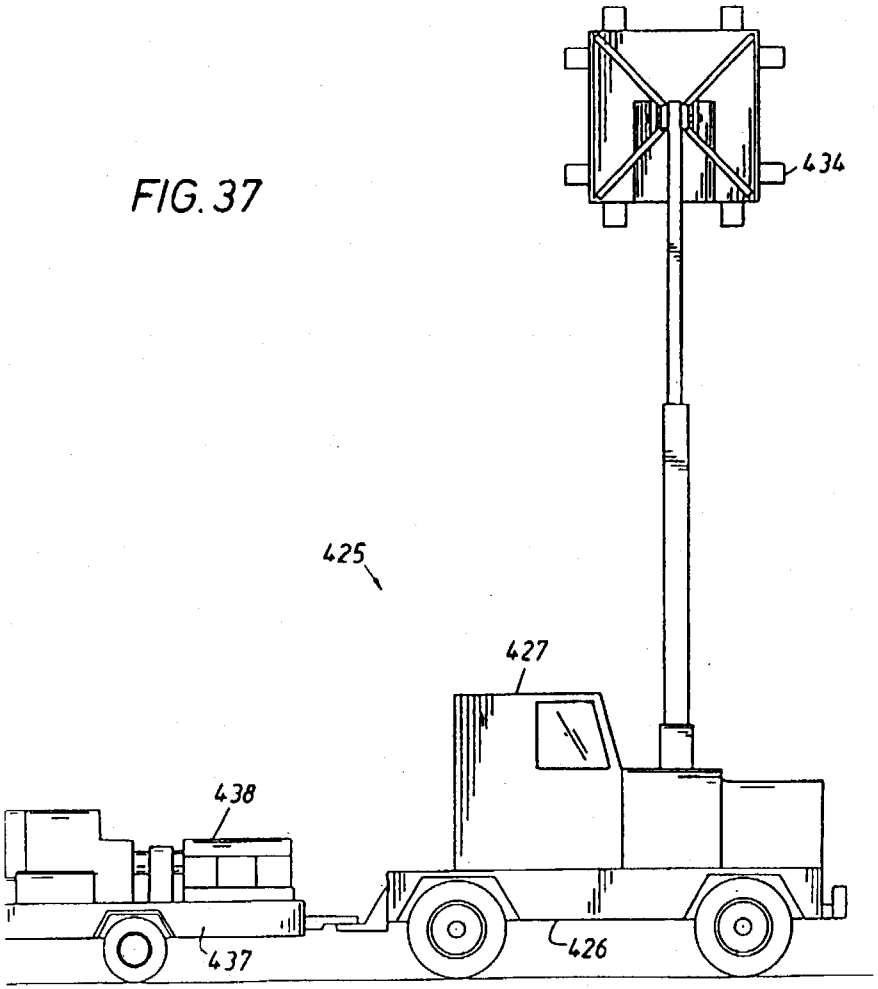
FIG. 37 is a side view of truck mounted apparatus utilizing a cherry picker for operation at elevated surfaces.

Attention is now directed to FIGS. 37 and 38 of the drawings which show another embodiment of the equipment. In these views, the equipment is adapted for cleaning a surface which is above grade elevation. Examples will be given. More particularly, these views show a cleaning apparatus 425 which is constructed with a tractor 426 provided with suitable powered and steering wheels. The tractor includes an enclosed cab 427 for an operator. As shown, an extendible boom 428 operates in the fashion of a cherry picker mechanism to extend thereby positioning the boom at a raised and extended position. The angle of the boom 428 is determined by a hydraulic cylinder 429 which controls boom elevation. Boom extension is obtained with the hydraulic cylinder 430. Both are controlled by the operator in the cab to position this equipment for contact against a surface to be cleaned. The boom terminates at a swivel 421, and the swivel supports four diagonal braces 432 which extend to the corners of a rectangular shroud or housing 433. At this instance, the shroud or housing encloses the nozzle driven cleaning apparatus similar to that shown in FIG. 15. It is also similar to the apparatus shown in FIGS. 32–34, and can have the rectangular shape as a shroud 412 which is shown with the embodiment 400. In this particular instance, the rectangular shroud is equipped on all four sides with protruding bumpers 434, or alternately with protruding non-driven rollers. The rollers assure that the device is able to track the surface to be cleaned.

One typical surface to be cleaned is identified by the numeral 435 and is representative of the hull of a ship. It can be readily cleaned while the ship is at the pier. An alternate large surface of this sort which requires periodic cleaning is a water or oil storage tank. Going back to FIG. 37, it will be observed that this set of equipment utilizes a trailer 437 which is pulled by the tractor 426. It is provided with a prime mover 438, and that in turn connects with a pump. For convenience sake the water lines extending to the elevated end of the boom 428 have been omitted. Operation of this particular embodiment is readily occasioned by driving the tractor 426 along the edge of the surface to be cleaned. It is stopped at appropriate locations. Moreover, the boom is extended to a raised position. An area is cleaned and the boom is retracted during cleaning. This enables cleaning of a vertical swath of a surface. Thereafter, the boom is extended again and the tractors move a few feet to clean the next swath. The operator is able to see the cleaned area, thereby permitting the operator to move forward to register the tractor in location so that the swath next formed by cleaning overlaps the adjacent swath.

Figure 39:
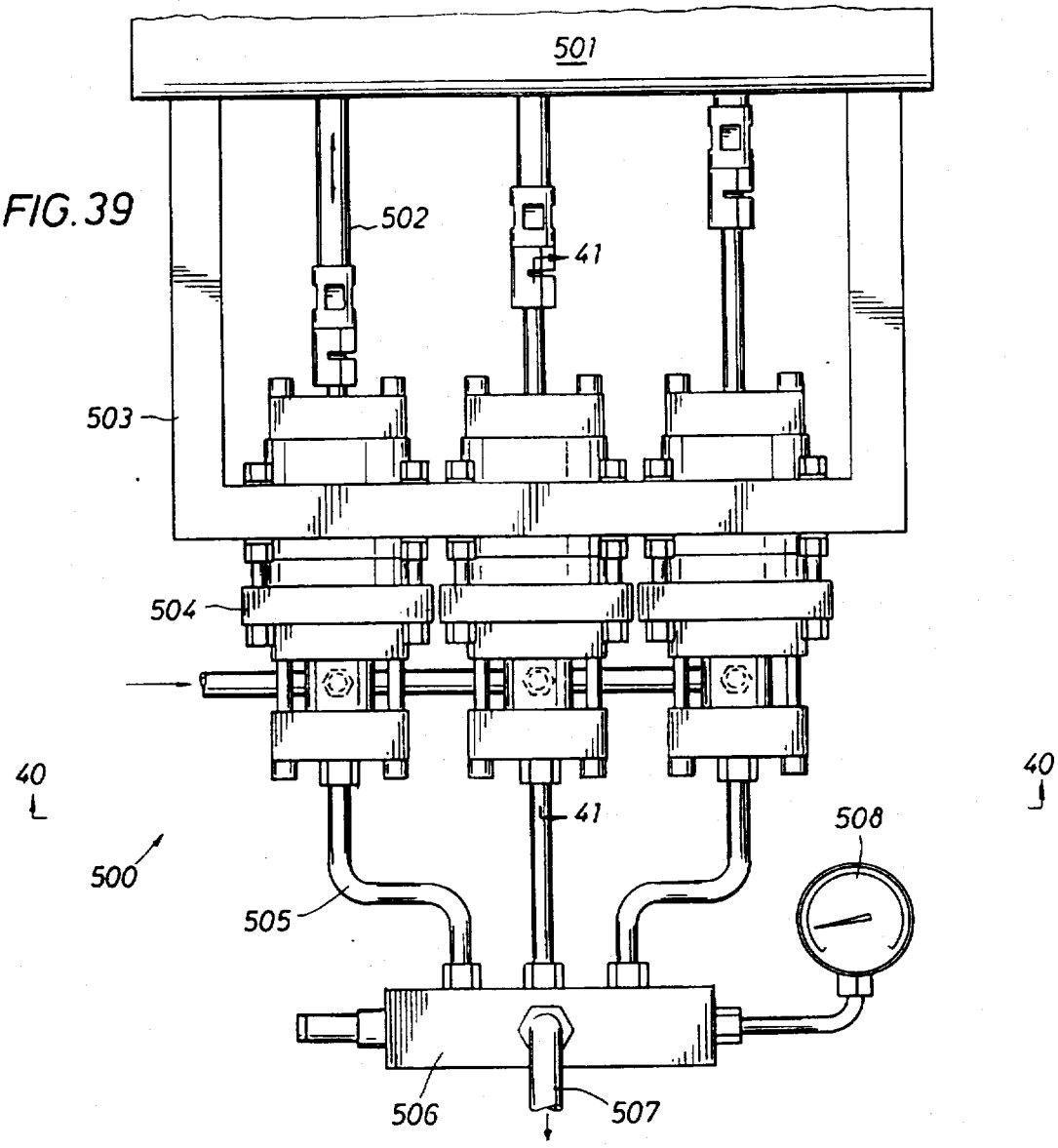
FIG. 39 is a plan view of a pump mechanism.
Figure 40:
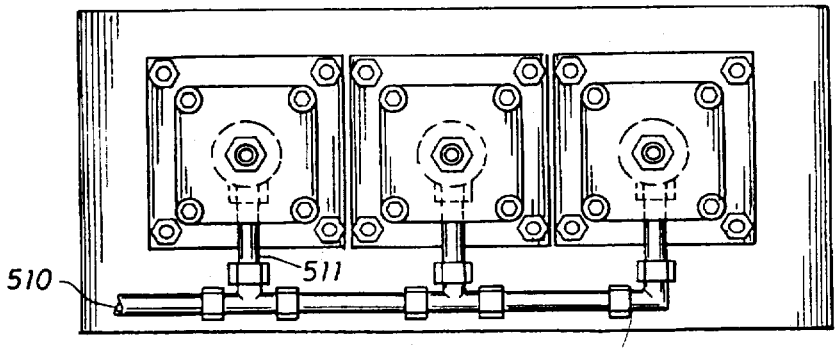
FIG. 40 is a view taken along the line 40—40 in FIG. 39 showing details of construction of several cylinder heads and appropriate interconnection of a manifold system.
Figure 41:
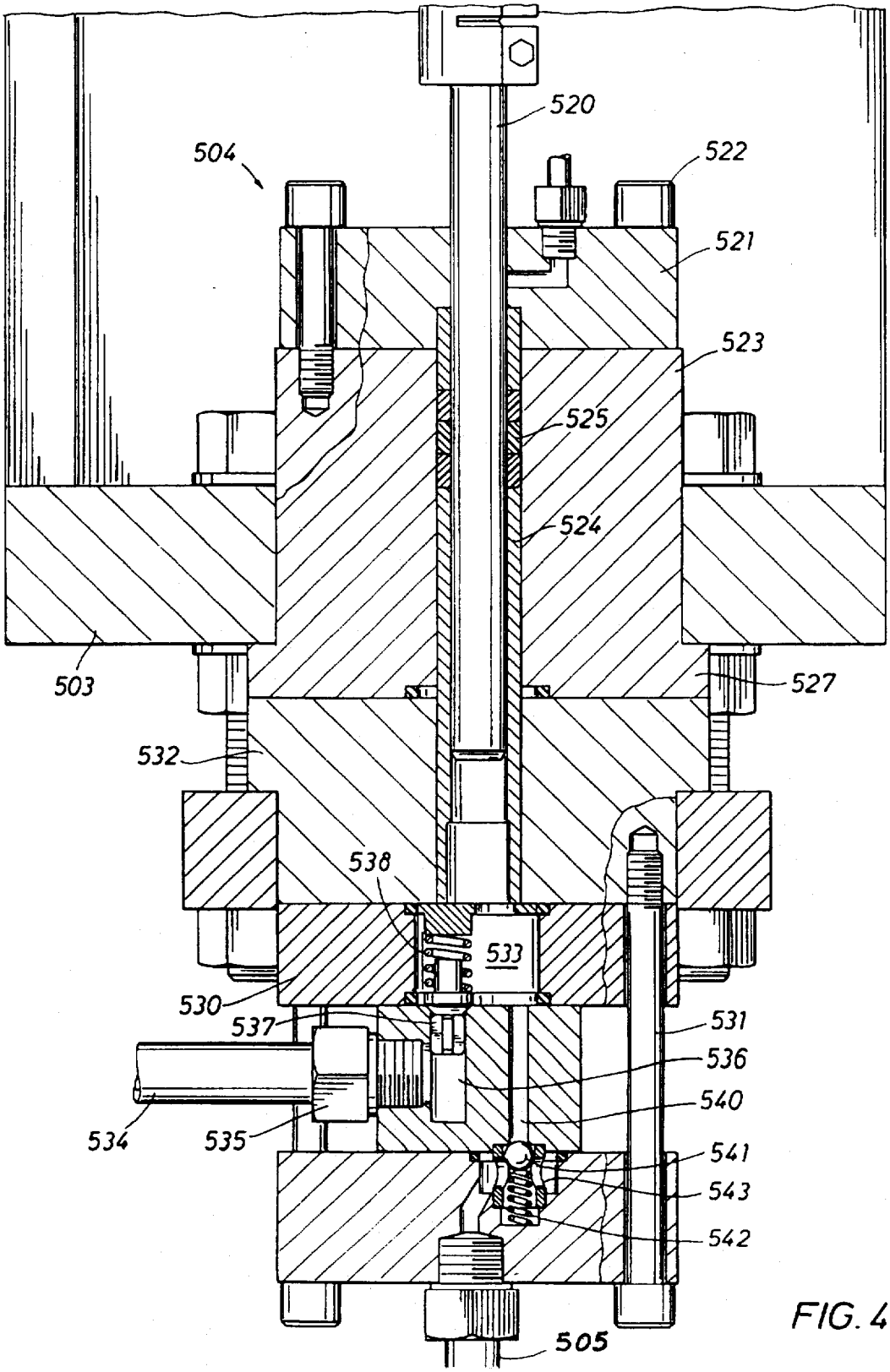
FIG. 41 is a sectional view taken along the line 41—41 in FIG. 39 through a cylinder of the pump and further showing details of construction of the flowlines, valves, and piston rods in the pump.

FIGS. 39–41, jointly show a triplex pump mechanism. The triplex pump 500 is shown in plan view in FIG. 39. The prime mover has been omitted but it is readily understood how the prime mover provides power to drive the pump 500.

Briefly, the pump 500 operates with a prime mover which provides pumping motion to it. The prime mover is enclosed in a cabinet or housing 501, and is constructed to provide reciprocating motion to a piston or pump rod 502. A protruding frame 503 formed of appropriate mounting brackets supports the several cylinders of the pump. Since they are all identical, a description of one will suffice. A first cylinder is identified at 504. It is powered with the rod 502 which is reciprocated. The cylinder 504 connects with a fluid flow line 505 to deliver fluid under pressure to a manifold 506. The manifold can be omitted if only a single cylinder is used, but the preferred form of the present apparatus involves at least two or three cylinders. Several cylinders connect with appropriate lines to the manifold 506, and the manifold in turn provides an output flow through the line 507. A meter movement 508 is likewise included. This reflects output pressure. As shown better in FIG. 40 of the drawings, a water feed line 510 is input to each of the several cylinders through feed lines 511 which branch from the line 510.

Going now to FIG. 41 of the drawings, a single pump is identified in greater detail. This particular pump 504 incorporates a driven rod 520 which is connected by suitable fitting to the rod 502 shown in FIG. 39. It extends through a cylinder head 521. Which is bolted by a suitable set of bolts 522 to a cylinder body 523. The body is drilled with a large diameter hole and a sleeve 524 is positioned in it, and the sleeve then supports a number of seal rings 525. The seal rings extend around the pump rod. Furthermore, the cylinder 523 is constructed with a protruding flange 527 which enables the cylinder to be locked to the frame member 503 for anchoring.

The cylinder 523 is therefore held in a fixed relationship to the reciprocating piston, and also supports the sleeve 524 which is located in it. The pumping action reciprocates the rod 520 which functions as a piston. Moreover, this enables water or other incompressible fluids to be delivered under pressure. The system includes a cylinder head 530. The head is secured to the cylinder 523 by suitable bolts 531. In this particular embodiment, the cylinder 523 is extended by a thick plate 532 which enables fabrication and multiple components. However, integral construction of the cylinder with the plate 532 certainly can be utilized. Suffice it say, the cylinder head 530 is clamped on the cylinder and defines a chamber 533 at the cylinder head 530. There is an inlet line 534 connected through suitable fittings 535. The inlet line 534 delivers fluid flow to an internal passage 536 which is connected with a metering insert 537 so that fluid flow is admitted to the chamber 533. The metering insert 537 is held in position by a compressed coil spring 538. This enables a controlled flow of fluid to be delivered to the chamber 533 on the upstroke of the rod 520, thereby filling the chamber, and enabling pumping under pressure on the downstroke as illustrated in FIG. 41.

An outlet passage 540 extends from the chamber 533. It terminates at a spherical check valve element 541 which is held in position by a bias spring 542. The check valve 541 is held in place by a cylindrical alignment sleeve 543 which is perforated so that high pressure fluid is delivered through the sleeve and into an outlet port 544 and then to an outlet line 505 previously identified in FIG. 39. As used elsewhere, suitable fittings make the connection.

Several advantages flow from the pump apparatus shown in FIGS. 39–41. Among these advantages, there is the benefit of ease of fabrication. This is significant because the system is required to handle such high pressures for the pumped liquid and therefore must also handle the resulting stresses. Stresses involved in the pumping action are quite high. To this end, the cylinder and cylinder head are not constructed as a unitary piece. It is more convenient to construct these components of multiple pieces and then to assemble them to form the cylinder with the appropriate head supporting the valves in the head. The components are clamped together using a set of head bolts. Clamping however is done in such fashion that the major components are pre-stressed with a compressive load applied through the multiple head bolts. So to speak, the head is formed of individual plates which plates are placed in compressive stress.

Another aspect of the present system is the incorporation of externally located valves seats that incorporate its own water supply inlet which is externally accessible. Rather than construct the valves by locating passages and seats within a head block, the head block being part of the cylinder, in this instance the valves and the associated passages are located in an individual component which is affixed by clamping action. In addition to that the stresses which are required to contain the liquid at the peak pressure on the liquid are distributed in the components forming the assembled cylinder so that stress is reduced. Speaking generally, the stress levels remain in the elastic range in that area. It is possible that the pressures are so high and the resulting stresses are so high that the region immediately parallel to the cylinder bore might be stressed into the plastic range. Such extremely high pressures and the resulted stresses pose no problem.

Notice should be taken of the pattern of movements of the respective cleaning nozzles. First of all, the nozzles in the embodiment shown in FIG. 1 and related views rotates in a circle. The center of the circle moves in a control pattern, namely forwardly parallel to the pipeline axis, and also moving transverse to the axis by a specified distance as the nozzle assembly is rotated, thereby cleaning a band around the pipeline. This rotational movement of the nozzle assembly is accomplished with plural nozzles as mentioned. Regarding an individual nozzle assembly, and focusing on the pathway of that, it moves laterally and returns in a two pass sequence. In other words, a specific region is treated with two separate passes. Separately from that, it is possible to operate with a different sequence. The locus of the nozzle assembly can be modified by changing the controlling sequence. As a generalization, it is desirable that the plural nozzle assemblies operate in unison with the same controlled and repeated pattern. One acceptable pattern was just described but an alternate and equally acceptable pattern involves forward motion along the length of the pipeline with the nozzle assembly motion transverse to the pipeline axis at each stop of the assembly, thereby resulting in alternating motions. In other words, the nozzle assembly supported in the carriage is moved clockwise around the pipeline, then advanced, and moved counter clockwise by an equal and opposite measure. For example, using four nozzle assemblies, the lateral motion can involve 90° of clockwise motion for the entire set of nozzle assemblies, advancing by a specified distance, and returning by rotation through 90° to restore the nozzle assemblies to the relative original position, rotationally speaking, with carriage advancement. Adjacent bands of cleaning formed by the plural nozzle assemblies can be overlapped as desired. While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method for treating a pipeline having an outer surface with a carriage mounted for longitudinal movement along the pipeline having a plurality of nozzles spaced at spaced intervals about the pipeline and mounted for oscillation concentric to the outer surface of the pipeline, the method including the following steps:

a) moving the carriage in a series of separate longitudinal steps of a specified distance along the pipeline while stopping periodically the carriage for a predetermined time period to initiate pipeline cleaning; and b) oscillating said nozzles in a predetermined arcuate stroke around the pipeline for each longitudinal step along the pipeline while operating the nozzles discharging cleaning liquid against the pipeline in the form of high pressure jets wherein the outer surface of the pipeline is treated along the external surface in a plurality of continuous cylindrical bands on the outer surface of the pipeline.

2. The method as set forth in claim 1 including the step of providing high pressure water to said nozzles for discharge against said pipeline.

3. The method as set forth in claim 2 including the step of providing an abrasive material entrained with said high pressure water for discharge against said pipeline.

4. The method as set forth in claim 1 including the steps of:

a) forming an enclosed housing about said nozzles wherein water and waste material removed from the outer surface of the pipeline collects in said housing;

b) removing said water and waste material from the housing;

c) separating said waste material from the removed water; and d) returning the separated water to said nozzles for reuse.

5. The method as set forth in claim 4 including the step of cooling the water prior to return to said nozzles for reuse.

6. The method as set forth in claim 1 including the steps of:

a) rotating said nozzles 360° during oscillation of said nozzles so that the rotating nozzles transcribe an elliptical path having a specified width on the outer surface of the pipeline; and b) moving said carriage after completing an oscillating stroke wherein the move is a longitudinal distance approximately equal to the width of the transcribed elliptical circular path on the pipeline so that the cleaned cylindrical bands overlap along the pipeline.

7. The method of claim 1 for cleaning a surface fluids, the steps further comprising:

a) supplying a high pressure fluid to said nozzles;

b) discharging the high pressure fluid from the nozzles;

c) rotating the nozzles in a circular path;

d) oscillating the nozzles in a circumferential direction around the pipeline to be cleaned; and e) after oscillation, moving the nozzles along the pipeline and repeating the steps a–d above.

8. A method for treating the outer surface of a round pipe with a carriage mounted for movement adjacent to the round pipe having a plurality of nozzles at spaced intervals and mounted for oscillation concentric to the outer circumference of the round pipe, the method including the following steps:

(a) moving the carriage in a series of separate longitudinal steps of a specified distance along the round pipe and stopping periodically for a predetermined time period to initiate pipe cleaning in a band on the outer surface of the pipe; and (b) oscillating said nozzles in a predetermined arcuate pattern around the pipe for each longitudinal step while operating the nozzles discharging cleaning liquid against the pipe in the form of high pressure jets wherein the outer surface of the pipe is treated in a plurality of adjacent cylindrical bands on the outer surface of the pipe.

9. The method as set forth in claim 8 including the step of providing high pressure water and an abrasive material entrained with said high pressure water to said nozzles for discharge against said pipe.

10. The method as set forth in claim 8 including the steps of:

(a) forming an enclosed housing about said nozzles wherein water and waste material from the outer surface of the pipe collects in said housing;

(b) removing said water and waste material from the housing;

(c) separating said waste material from the removed water; and (d) returning the separated water to said nozzles for reuse.

11. The method as set forth in claim 8 including the steps of:

(a) installing plural evenly spaced nozzles in a circle around said pipe;

(b) rotating said nozzles 360° divided by the number of spaced nozzles during oscillation of said nozzles so that the rotating nozzles transcribe a clean area on the outer surface of the pipe; and (c) moving said carriage after completing cleaning of an area wherein the move is a longitudinal distance approximately equal to the width of the cleaned circular path so that the cleaned cylindrical bands overlap along the pipe.

12. A method for treating the outer surface of a pipeline with a carriage mounted for movement adjacent to the pipeline having a plurality of nozzles at spaced intervals and mounted for oscillation concentric to the outer circumference of the pipeline, the method including the following steps:

(a) mounting a movable carriage on a pipeline extending along the surface of the earth for movement therealong;

(b) defining a preferred position for the carriage with respect to a vertical reference;

(c) moving the carriage in a series of separate longitudinal steps of a specified distance along the pipeline and stopping periodically for a predetermined time period to initiate pipeline cleaning; and (d) oscillating said nozzles in a predetermined arcuate stroke around the pipeline for each longitudinal step while operating the nozzles discharging cleaning liquid against the pipeline in the form of high pressure jets wherein the outer surface of the pipeline is treated along the surface in a plurality of adjacent cylindrical bands on the outer surface of the pipeline;

(e) correcting the upstanding position of the pipeline so that it maintains a constant position with respect to the vertical reference during travel along the pipeline;

(f) controllably limiting the arcuate stroke around the pipeline for each longitudinal step so that the stroke at a first position along the pipeline enables the nozzle supported thereby to fully encircle in cleaning action said pipeline; and (g) limiting the oscillation so that the evenly spaced nozzles supported by said carriage clean around said pipeline.

13. The method of claim 12 including the step of controlling the longitudinal movement of said carriage along the pipeline so that a cylindrical band on the outer surface of said pipeline is cleaned for each step, and cleaning in said cylindrical bands enables adjacent bands to totally cover the outer surface of said pipeline.

14. The method of claim 12 including the steps of:

(a) forming an enclosed housing about said nozzles wherein water and waste material removed from the outer surface of the cylinder collects in said housing;

(b) removing said water and waste material from the housing;

(c) separating said waste material from the removed water;

(d) returning the separated water to said nozzles for reuse;

(e) heating and recycling the water;

(f) mixing a powdered abrasive material in the water; and (g) separating the abrasive material with the waste material.

15. The method of claim 12 including the step of installing a gravity seeking reference member, and periodically measuring the position of the carriage with respect to the gravity seeking member so that deviation as determined thereby provides a correction signal, and using the correction signal to restore controllably the carriage to a specified relationship to gravity.

* * * * *